US009909413B2

(12) United States Patent
van Oort et al.

(10) Patent No.: US 9,909,413 B2
(45) Date of Patent: Mar. 6, 2018

(54) SYSTEMS AND METHODS FOR DETERMINING A RHEOLOGICAL PARAMETER

(71) Applicant: Board of Regents, The University of Texas System, Austin, TX (US)

(72) Inventors: Eric van Oort, Bee Cave, TX (US); Ali Karimi Vajargah, Austin, TX (US); Besmir B. Hoxha, Houston, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 145 days.

(21) Appl. No.: 14/712,564

(22) Filed: May 14, 2015

(65) Prior Publication Data

US 2015/0330213 A1 Nov. 19, 2015

Related U.S. Application Data

(60) Provisional application No. 61/992,957, filed on May 14, 2014.

(51) Int. Cl.

| | |
|---|---|
| ***E21B 47/10*** | (2012.01) |
| ***E21B 47/06*** | (2012.01) |
| *E21B 49/08* | (2006.01) |

(52) U.S. Cl.

CPC ..... *E21B 47/10* (2013.01); *E21B 47/06* (2013.01); *E21B 2049/085* (2013.01)

(58) Field of Classification Search

CPC ..... E21B 47/10

See application file for complete search history.

(56) References Cited

U.S. PATENT DOCUMENTS

| | | | |
|---|---|---|---|
| 3,468,158 | A | 9/1969 | Chien |
| 4,384,792 | A | 5/1983 | Sommers et al. |

(Continued)

OTHER PUBLICATIONS

Ahmed et al. "Friction Pressure Loss Determination of Yield Power Law Fluid in Eccentric Annular Laminar Flow," Wiertnictwo Nafta Gaz, 2006, 23(1), 47-53.

(Continued)

*Primary Examiner* — Ryan Walsh

(74) *Attorney, Agent, or Firm* — Meunier Carlin & Curfman LLC

(57) ABSTRACT

The present disclosure relates to systems and methods for determining a rheological parameter of a fluid within a wellbore. The methods comprise receiving a plurality of differential pressure measurements of a fluid within a flow region of the wellbore; storing the plurality of differential pressure measurements; generating a curve based on the plurality of differential pressure measurements; and determining the rheological parameter of the fluid using the curve. The systems comprise a conduit arranged in a wellbore; a plurality of pressure sensors along the conduit configured to measure pressure of the fluid within the wellbore; and a processing device. The processing device is configured to: receive a plurality of differential pressure measurements of the fluid from the pressure sensors; store the plurality of differential pressure measurements; generate a curve based on the plurality of differential pressure measurements; and determine the rheological parameter of the fluid using the curve.

26 Claims, 13 Drawing Sheets

(56) References Cited

U.S. PATENT DOCUMENTS

| | | | | |
|---|---|---|---|---|
| 4,557,142 | A | 12/1985 | Hensley et al. | |
| 4,680,957 | A | 6/1987 | Dodd | |
| 5,042,296 | A | 8/1991 | Burgess | |
| 5,315,863 | A | 5/1994 | Cowper | |
| 5,741,978 | A | 4/1998 | Gudmundsson et al. | |
| 6,691,561 | B2 | 2/2004 | Lin et al. | |
| 6,755,079 | B1 | 6/2004 | Proett et al. | |
| 7,036,362 | B2 | 5/2006 | Haddad et al. | |
| 8,321,190 | B2 | 11/2012 | Hansen et al. | |
| 8,881,577 | B1 | 11/2014 | Agar et al. | |
| 2003/0029640 | A1 | 2/2003 | Cooper | |
| 2008/0264182 | A1* | 10/2008 | Jones | G01F 1/34 73/861.63 |
| 2009/0308601 | A1* | 12/2009 | Poe, Jr. | E21B 47/06 166/250.01 |
| 2010/0139374 | A1 | 6/2010 | Dermody et al. | |
| 2011/0042076 | A1* | 2/2011 | Reitsma | E21B 21/08 166/250.01 |
| 2011/0199228 | A1* | 8/2011 | Roddy | E21B 33/13 340/856.4 |
| 2013/0025359 | A1 | 1/2013 | Cartellieri et al. | |
| 2013/0048380 | A1* | 2/2013 | Rasmus | E21B 47/00 175/40 |
| 2013/0090855 | A1* | 4/2013 | Rasmus | E21B 47/06 702/9 |
| 2013/0345994 | A1* | 12/2013 | Wiklund | G01F 1/34 702/46 |
| 2014/0012507 | A1* | 1/2014 | Trehan | G01V 11/002 702/12 |
| 2014/0131104 | A1* | 5/2014 | Coley | E21B 47/06 175/48 |
| 2015/0059446 | A1 | 3/2015 | Agar et al. | |

OTHER PUBLICATIONS

Broussard et al. "Making real-time fluid decisions with real-time fluid data at the rig site." Society of Petoleum Engineers 2010, SPE-137999-MS.

Gravdal et al. "Wired drill pipe telemetry enables real-time evaluation of kick in Managed Pressure Drilling," Society of Petroleum Engineers, 2010, SPE-132989-MS.

Haciislamoglu et al."Non-Newtonian flow in eccentric annuli", Journal of Energy Resources, 1990, 112, 163-169.

Hernandez et al. "High-speed wired drill-string telemetry network delivers increased safety, efficiency, reliability and productivity to the drilling industry," Society of Petroleum Engineers, 2008, SPE-113157-MS.

Kotze et al. "A feasibility study of in-line rheological characterisation of a wastewater sludge using ultrasound technology." Water SA, 2014, 40(4), 580-586.

Lesso et al. "The utilization of the massive amount of real time data acquired in wired-drillpipe operations," Society of Petroleum Engineers, 2008, SPE-112702-MS.

MacPherson et al. "Drilling-systems automation: Current state, initiatives, and potential impact," Society of Petroleum Engineers, 2013, SPE-166263-PA.

Reeves et al. "Intelligent drill string field trials demonstrate technology functionality," Society of Petroleum Engineers, 2005, SPE-92477-MS.

Stock et al. "The development and successful application of an automated real-time drilling fluids measurement system." Society of Petroleum Engineers, 2012, SPE-150439-MS.

Vajargah et al. "Feasibility study of applying intelligent drill pip in early detection of gas influx during conventional drilling," Society of Petroleum Engineers, 2013, SPE-163445-MS.

Veeningen, Daan. "Along-string pressure evaluation enabled by broadband networked drillstring provide safety, efficiency gains," Offshore Technology Conference, Rio de Janeiro, Brazil, Oct. 4-6, 2011, doi:10.4043/22239-MS.

Weir, Iain. "A Statistical Study of Rheological Models for Drilling Fluids," Society of Petroleum Engineers, 1996, SPE 36359.

Zamora et al. "Comparing a Basic Set of Drilling Fluid Pressure-Loss Relationships to Flow-Loop" AADE 2005 National Technical Conference and Exhibition, Houston, Apr. 5-7, 2005, AADE-05-NTCE-27.

International Search Report and Written Opinion dated Aug. 12, 2015, in related International Application No. PCT/US15/30783.

* cited by examiner

SYSTEMS AND METHODS FOR DETERMINING A RHEOLOGICAL PARAMETER

CROSS-REFERENCE TO RELATED APPLICATIONS

This application claims benefit of U.S. Provisional Application No. 61/992,957, filed May 14, 2014, which is hereby incorporated herein by reference in its entirety.

FIELD OF THE INVENTION

The present disclosure relates to systems and methods for determining a rheological parameter of a fluid within a wellbore.

BACKGROUND

Measuring rheological properties of fluids for optimum maintenance and optimum wellbore hydraulic management is one of the most important tasks during drilling and other downhole operations. This task is conducted by viscosity measurements that express a relationship between shear stress and shear rate. In drilling practice, such measurements are carried out at the rig site using test protocols and equipment as standardized by the American Petroleum Institute (API), such as API standards 13-B1, 13-B2, 13C and 13D.

Currently, the rheology determination is carried out with simplistic equipment at atmospheric pressure and standardized temperatures at the surface. The obtained rheology measurements therefore do not properly reflect the actual well conditions experienced by the fluid within the wellbore. Furthermore, measurements are not performed in real time and are conducted depending on the availability of the mud engineer. Inaccurate measurements of the rheological properties can possibly lead to miscalculated predictions of annular frictional pressure drops and Equivalent Circulating Density (ECD).

These rheological parameters are even more crucial during offshore drilling operations where a correct calculation of the ECD is vital. During offshore drilling operations the "mud window," i.e. the difference between the fracture gradient and the pore pressure (or the mud pressure required to prevent shear failure at the wellbore wall, whichever of the two is higher), tends to be very narrow. Exceeding the boundaries of the mud window usually results in significant well trouble (e.g., well control incidents, lost circulation, borehole instability, stuck pipe, etc.) and associated trouble time and recovery costs. The methods and systems herein address these and other needs.

SUMMARY

Described herein are methods for determining a rheological parameter of a fluid within a wellbore. In some examples, the method comprises receiving, using a processing device, a plurality of differential pressure measurements of the fluid within a flow region of the wellbore; storing, using the processing device, the differential pressure measurements; generating, using the processing device, a curve based on the differential pressure measurements; and determining, using the processing device, the rheological parameter of the fluid using the curve. In some examples, the differential pressure measurements of the fluid are obtained at downhole conditions of the wellbore.

In some examples, receiving the differential pressure measurements of the fluid flowing within a flow region of the wellbore comprises receiving, using a processing device, pressure measurements of the fluid from a plurality of pressure sensors; and calculating, using the processing device, the differential pressure measurements of the fluid from the pressure measurements.

In some examples, the generating and determining steps comprise generating, using the processing device, a pressure curve based on the differential pressure measurements, and determining, using the processing device, the rheological parameter of the fluid using the pressure curve.

In some examples, the plurality of differential pressure measurements correspond to a plurality of measured flow rates of the fluid flowing within a flow region of the wellbore and said receiving and storing steps comprise receiving and storing, using the processing device, the differential pressure measurements for the flow rates of the fluid. In some examples, the flow rates can include at least three or at least five different flow rates.

In some examples, the method further comprises generating, using the processing device, a flow curve based on the differential pressure measurements and the plurality of flow rates; determining, using the processing device, a flow behavior index for the fluid from the flow curve; and determining, using the processing device, the rheological parameter of the fluid using the flow curve and a rheological model.

In some examples, the method further comprises correcting, using the processing device, the differential pressure measurements of the fluid for eccentricity between a conduit and the wellbore. For example, the differential pressure measurements of the fluid can be corrected for the eccentricity between the conduit and the wellbore using an equivalent pipe model, a correlation-based model, or a combination thereof.

In some examples, the flow region can include an area inside a conduit situated within the wellbore. For example, the flow region can include an annulus between the conduit and the wellbore. In some examples, the fluid is a drilling fluid.

In some examples, the flow curve can be used to produce a logarithmic plot of shear stress at a wall of the conduit versus nominal Newtonian shear rate. For example, the slope of the logarithmic plot can include a generalized flow behavior index and the intercept of the logarithmic plot can include a generalized consistency index. The rheological model can include a model that can relate shear stress and shear rate. In some examples, the rheological model comprises the Yield Power Law model. In some examples, the rheological parameter is determined based on a shear stress and a shear rate of the fluid.

In some examples, the method further comprises receiving, using the processing device, times corresponding to each of the differential pressure measurements of the fluid. The method can further comprise generating, using the processing device, a pressure curve over time based on the differential pressure measurements of the fluid. The method can further comprise estimating, using the processing device, the gel strength of the fluid using the pressure curve over time.

Also disclosed herein are systems for determining a rheological parameter of a fluid within a wellbore. The system, for example, can comprise a conduit arranged in a wellbore. In some examples, the system further comprises a plurality of pressure sensors configured to measure pressure of the fluid flowing within the wellbore. The system can further comprise a processing device configured to receive a plurality of differential pressure measurements of the fluid from the pressure sensors, store the differential pressure measurements, generate a curve based on the differential pressure measurements, and determine the rheological parameter of the fluid using the curve.

In some examples, the system can further comprise a flow meter configured to measure flow rate of the fluid flowing within the wellbore, and the processing device can be further configured to receive a plurality of flow rates of the fluid from the flow meter, receive differential pressure measurements of the fluid from the pressure sensors for the plurality of flow rates of the fluid, store the differential pressure measurements for the plurality of flow rates of the fluid, generate a flow curve based on the differential pressure measurements for the plurality of flow rates of the fluid, and determine the rheological parameter of the fluid using the flow curve and a rheological model. In some examples, the plurality of pressure sensors along the conduit are configured to measure the pressure of the fluid flowing within an annulus of the wellbore, the annulus of the wellbore being a region between the conduit and the wellbore. The system can include the other features described herein with respect to the disclosed method.

The details of one or more embodiments are set forth in the description below. Other features, objects, and advantages will be apparent from the description and from the claims and the drawings.

DETAILED DESCRIPTION

Figure 1:
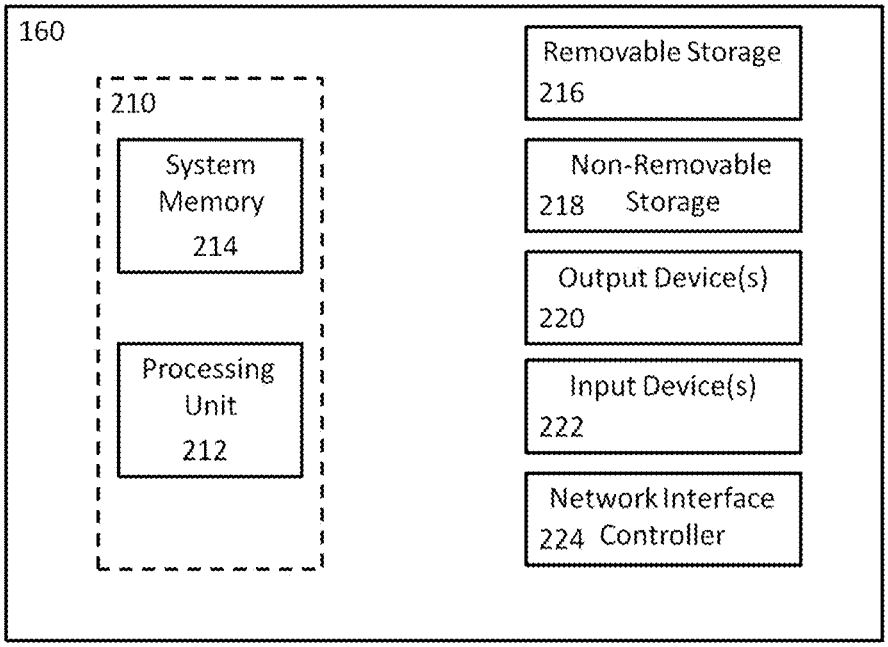
FIG. 1 is a schematic of an exemplary processing device.

Described herein are methods for determining a rheological parameter of a fluid within a wellbore. In some examples, the rheological parameter can be determined from a shear stress and a shear rate of the fluid. For examples, the rheological parameter can be determined from a relationship between the shear stress and shear rate of the fluid. The fluid can comprise any fluid used in a wellbore application such as, for example, a drilling fluid, a spacer fluid, a cementitious fluid, a packer fluid, a completion fluid, a completion brine fluid, a drill-in fluid, or a combination thereof. In some examples, the method comprises receiving, using a processing device, a plurality of differential pressure measurements of the fluid flowing within a flow region of the wellbore. In some examples, the plurality of differential pressure measurements can correspond to a plurality of measured flow rates of the fluid flowing within a flow region of the wellbore. In some examples, receiving the plurality of flow rates of the fluid flowing within a flow region of the wellbore comprises receiving, using a processing device, a plurality of flow rates of the fluid from a flow meter. The plurality of flow rates can, for example, comprise a plurality of flow rates obtained from substantially steady state flow conditions. In some examples, the plurality of flow rates includes at least 3 (e.g., at least 4, at least 5, at least 10, or at least 50) different flow rates. In some examples, the plurality of flow rates can be derived from a continuous pump ramp-up curve. In some examples, the plurality of flow rates can be derived from steady state conditions.

In some examples, the respective differential pressure measurements for the plurality of flow rates of the fluid are obtained at downhole conditions (e.g., downhole temperatures and pressures) of the wellbore. The wellbore can be a vertical wellbore, a deviated wellbore, a horizontal wellbore, or a combination thereof.

The differential pressure measurement for flow rate of the fluid can, for example, be in a laminar flow regime, a transitional flow regime, a turbulent flow regime, or combinations thereof. In some examples, the differential pressure measurements for flow rate of the fluid are in a laminar flow regime.

The flow region of the wellbore can comprise any region where the fluid can flow and pressure can be measured within the wellbore. In some examples, the flow region comprises an area inside a conduit (e.g., a drill pipe, a wired drill pipe, a tube, or a casing) situated within the wellbore.

In some examples, the flow region comprises an annulus. The annulus, for example, can comprise a region between the conduit and the wellbore, a region between a bottom-hole assembly and the wellbore, or a combination thereof.

In some examples, receiving the differential pressure measurements of the fluid flowing within a flow region of the wellbore comprises receiving, using a processing device, pressure measurements of the fluid from a plurality of pressure sensors. In some examples, receiving the differential pressure measurements of the fluid flowing within a flow region of the wellbore further comprises calculating, using the processing device, the differential pressure measurements of the fluid from the pressure measurements.

In some examples, the plurality of pressure sensors can be arranged on a wired drill pipe situated within the wellbore. A wired drill pipe can comprise, for example, a stainless steel, armored coaxial cable that can run between the pin and box within the wired drill pipe. The wired drill pipe can further comprise, for example, induction coils at the pin and box of each connection. In some examples, the wired drill pipe can further comprise electronic elements known as booster assemblies that can boost the data signal as it travels along the wired drill pipe. These booster assemblies can, for example, prevent signal degradation and allow for taking measurements along the entire length of the wired drill pipe.

A high-speed, wired drill-string telemetry network can deliver increased safety, efficiency, reliability and productivity to the drilling industry. The ability to continuously transmit data at high speed (interrupted only while making drill-string connections), completely independent of fluid properties and flow rate (including no flow), allows monitoring of a wide array of well status information.

In a wired drill pipe, for example, an electromagnetic field associated with an alternating current signal transmitted through a cable can transmit data. The alternating electromagnetic field from one coil can induce an alternating current signal in another nearby coil, and thus can allow data to be transmitted from one section of the wired drill pipe to the next. Because the broadband telemetry can work independently from the medium present, the wired drill pipe can transmit data regardless of fluid environment.

In some examples, the method further comprises correcting, using the processing device, the respective differential pressure measurements of the fluid for eccentricity between the conduit and the wellbore. Correcting for eccentricity between the conduit and the wellbore can, for example, comprise using any suitable model, such as an equivalent pipe model, a correlation-based model, or a combination thereof.

In some examples, the method further comprises storing, using the processing device, the respective differential pressure measurements of the fluid. In some examples, the method further comprises generating, using the processing device, a curve based on the plurality of differential pressure measurements. As used herein, a "curve" can refer to any type of plot or graphic representation of a mathematical function or relationship. For example, a curve can include a plot of a line, a parabola, a hyperbola, and the like, or any combination thereof. In some examples, the curve can comprise a flow curve, a pressure curve, or a combination thereof. In some examples, the method further comprises determining, using the processing device, the rheological parameter of the fluid from the curve.

In some examples, the differential pressure measurements can correspond to a plurality of flow rates of the fluid. In some examples, the method further comprises storing, using the processing device, the respective differential pressure measurements and the plurality of flow rates of the fluid. In some examples, the method further comprises generating, using the processing device, a flow curve based on the plurality of differential pressure measurements and the plurality of flow rates. In some examples, the method further comprises determining, using the processing device, a flow behavior index for the fluid from the flow curve. The flow curve, for example, can be used to produce a logarithmic plot (e.g., a log-log plot, a ln-ln plot, etc.) of shear stress at a wall of the conduit versus nominal Newtonian shear rate. In some examples, the slope of the logarithmic plot comprises the generalized flow behavior index and the intercept of the logarithmic plot comprises a generalized consistency index.

In some examples, the method further comprises determining, using the processing device, the rheological parameter of the fluid using the flow behavior index and a rheological model. For example, the method can include determining, using the processing device, the rheological parameter of the fluid using the flow behavior index determined from the flow curve and a rheological model.

The rheological model can comprise any model that can relate shear stress and shear rate. Suitable rheological models include, but are not limited to, the Bingham Plastic model; Casson model; Collins-Graves model; Modified Collins-Graves model; Cross model; Ellis, Lanham and Pankhurst model; Herschel-Bulkley model (Yield Power Law model); Herschel-Bulkley/Linear model; Hyperbolic model; Modified Hyperbolic model; Inverse ln-cosh model; Power Law model; Power Law/Linear model; Prandtl-Eyring model; Modified Prandtl-Eyring model; Reiner-Philippoff model; Robertson-Stiff model; Modified Robertson-Stiff model; Sisko model; and Modified Sisko model. In some examples, the rheological model comprises the Yield Power Law model.

Each rheological model can relate shear stress to shear rate through different equations and different parameters as provided, for example, in Weir I S and Bailey W J, "A Statistical Study of Rheological Models for Drilling Fluids," Society of Petroleum Engineers, Dec. 1, 1996, which is incorporated herein by reference for its teaching of rheological models and their parameters. For example, the Bingham Plastic model relates shear stress to shear rate via yield stress and high shear limiting viscosity. The Casson model relates shear stress to shear rate via yield stress and high shear limiting viscosity. The Collins-Graves model relates shear stress to shear rate via yield stress and consistency factor (index) and a constant. The Modified Collins-Graves model relates shear stress to shear rate via yield stress and consistency factor (index) and a constant. The Cross model relates shear stress to shear rate via high shear limiting viscosity and low shear limiting viscosity and a constant. The Ellis, Lanham and Pankhurst model relates shear stress to shear rate via a series of constants. The Herschel-Bulkley model (e.g., Yield Power Law model) relates shear stress to shear rate via yield stress, flow behavior index and consistency factor (index). The Herschel-Bulkley/Linear model relates shear stress to shear rate via a series of constants. The Hyperbolic model relates shear stress to shear rate via a series of constants. The Modified Hyperbolic model relates shear stress to shear rate via a series of constants. The Inverse ln-cosh model relates shear stress to shear rate via yield stress and a series of constants. The Power Law model relates shear stress to shear rate via consistency factor (index), and flow behavior index. The Power Law/Linear model relates shear stress to shear rate via consistency factor (index), and flow behavior index. The Prandtl-Eyring model relates shear stress to shear rate via a series of constants. The Modified Prandtl-Eyring model relates shear stress to shear rate via yield stress and a series of constants. The Reiner-Philippoff model relates shear stress to shear rate via high shear limiting viscosity, low shear limiting viscosity, and yield stress. The Robertson-Stiff model relates shear stress to shear rate via consistency factor, flow behavior index, and a constant. The Modified Robertson-Stiff model relates shear stress to shear rate via consistency factor, flow behavior index, and a constant. The Sisko model relates shear stress to shear rate via yield stress and a series of constants. The Modified Sisko model relates shear stress to shear rate via yield stress and a series of constants.

In some examples, the method further comprises receiving, using the processing device, respective times corresponding to each of the differential pressure measurements of the fluid. The method can further comprise generating, using the processing device, a pressure curve over time based on the differential pressure measurements of the fluid. The method can further comprise estimating, using the processing device, a rheological parameter of the fluid using the pressure curve over time. For example, the method can include estimating a gel strength for the fluid. The gel strength is the stress involved to initiate flow of the fluid from a previously static (e.g., non-flowing) condition.

The methods herein can be used with laminar flow, turbulent flow, transitional flow, or a combination thereof. In some examples, it may be desirable to account for any values that are outside of laminar flow such as in transitional or turbulent flow. One method of doing this is to disregard data points that were obtained during transitional and/or turbulent flow before calculating the rheological parameter.

The methods disclosed herein can be carried out in whole or in part on one or more processing devices. FIG. 1 illustrates a suitable processing device upon which the methods disclosed herein may be implemented. The processing device 160 can include a bus or other communication mechanism for communicating information among various components of the processing device 160. In its most basic configuration, a processing device 160 typically includes at least one processing unit 212 (a processor) and system memory 214. Depending on the exact configuration and type of processing device, the system memory 214 may be volatile (such as random access memory (RAM)), non-volatile (such as read-only memory (ROM), flash memory, etc.), or some combination of the two. This most basic configuration is illustrated in FIG. 1 by a dashed line 210. The processing unit 212 may be a standard programmable processor that performs arithmetic and logic operations necessary for operation of the processing device 160.

The processing device 160 can have additional features/functionality. For example, the processing device 160 may include additional storage such as removable storage 216 and non-removable storage 218 including, but not limited to, magnetic or optical disks or tapes. The processing device 160 can also contain network connection(s) 224 that allow the device to communicate with other devices. The processing device 160 can also have input device(s) 222 such as a keyboard, mouse, touch screen, antenna or other systems configured to communicate with the camera in the system described above, etc. Output device(s) 220 such as a display, speakers, printer, etc. may also be included. The additional devices can be connected to the bus in order to facilitate communication of data among the components of the processing device 160.

The processing unit 212 can be configured to execute program code encoded in tangible, computer-readable media. Computer-readable media refers to any media that is capable of providing data that causes the processing device 160 (i.e., a machine) to operate in a particular fashion. Various computer-readable media can be utilized to provide instructions to the processing unit 212 for execution. Common forms of computer-readable media include, for example, magnetic media, optical media, physical media, memory chips or cartridges, a carrier wave, or any other medium from which a computer can read. Example computer-readable media can include, but is not limited to, volatile media, non-volatile media and transmission media. Volatile and non-volatile media can be implemented in any method or technology for storage of information such as computer readable instructions, data structures, program modules or other data and common forms are discussed in detail below. Transmission media can include coaxial cables, copper wires and/or fiber optic cables, as well as acoustic or light waves, such as those generated during radio-wave and infra-red data communication. Example tangible, computer-readable recording media include, but are not limited to, an integrated circuit (e.g., field-programmable gate array or application-specific IC), a hard disk, an optical disk, a magneto-optical disk, a floppy disk, a magnetic tape, a holographic storage medium, a solid-state device, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices.

For example, the processing unit 212 can execute program code stored in the system memory 214. For example, the bus can carry data to the system memory 214, from which the processing unit 212 receives and executes instructions. The data received by the system memory 214 can optionally be stored on the removable storage 216 or the non-removable storage 218 before or after execution by the processing unit 212.

The processing device 160 typically includes a variety of computer-readable media. Computer-readable media can be any available media that can be accessed by device 160 and includes both volatile and non-volatile media, removable and non-removable media. Computer storage media include volatile and non-volatile, and removable and non-removable media implemented in any method or technology for storage of information such as computer readable instructions, data structures, program modules or other data. System memory 214, removable storage 216, and non-removable storage 218 are all examples of computer storage media. Computer storage media include, but are not limited to, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by processing device 160. Any such computer storage media can be part of processing device 160.

It should be understood that the various techniques described herein can be implemented in connection with hardware or software or, where appropriate, with a combination thereof. Thus, the methods, systems, and associated signal processing of the presently disclosed subject matter, or certain aspects or portions thereof, can take the form of program code (i.e., instructions) embodied in tangible media, such as floppy diskettes, CD-ROMs, hard drives, or any other machine-readable storage medium wherein, when the program code is loaded into and executed by a machine, such as a processing device, the machine becomes an apparatus for practicing the presently disclosed subject matter. In the case of program code execution on programmable computers, the processing device generally includes a processor, a storage medium readable by the processor (including volatile and non-volatile memory and/or storage elements), at least one input device, and at least one output device. One or more programs can implement or utilize the processes described in connection with the presently disclosed subject matter, e.g., through the use of an application programming interface, reusable controls, or the like. Such programs can be implemented in a high level procedural or object-oriented programming language to communicate with a computer system. However, the program(s) can be implemented in assembly or machine language, if desired. In any case, the language can be a compiled or interpreted language and it may be combined with hardware implementations.

Also disclosed herein are systems for determining a rheological parameter (e.g., one or more rheological parameters) of a fluid within a wellbore. The system can be used to measure a rheological parameter using the methods described herein. The system, for example, can comprise a conduit arranged in a wellbore. In some examples, the system further comprises a plurality of pressure sensors configured to measure pressure of the fluid within the flow region.

The system can further comprise a processing device. The processing device can be configured to receive a plurality of differential pressure measurements of the fluid from the pressure sensors, store the differential pressure measurements, generate a curve based on the differential pressure measurements, and determine the rheological parameter of the fluid using the curve.

In some examples, receiving differential pressure measurements of the fluid from the pressure sensors comprises receiving pressure measurements of the fluid from the pressure sensors, and calculating the differential pressure measurements of the fluid from the respective pressure measurements.

In some embodiments, the system can further comprise a flow meter configured to measure a flow rate of the fluid within a flow region of a wellbore, e.g., the fluid within an annulus of the wellbore.

In some examples, the processing device can be further configured to receive a plurality of flow rates of the fluid from the flow meter, receive differential pressure measurements of the fluid from the pressure sensors for the plurality of flow rates of the fluid, store the differential pressure measurements for the plurality of flow rates of the fluid, generate a flow curve based on the differential pressure measurements for the plurality of flow rates of the fluid, and determine the rheological parameter of the fluid using the flow curve and a rheological model. In some examples, the plurality of pressure sensors along the conduit are configured to measure the pressure of the fluid flowing within an annulus of the wellbore, the annulus of the wellbore being a region between the conduit and the wellbore.

In some examples of the system, the processing device is further configured to correct the differential pressure measurements of the fluid for eccentricity between the conduit and the wellbore. Correcting for eccentricity between the conduit and wellbore can comprise using any suitable model, such as an equivalent pipe model, a correlation-based model, or combinations thereof.

In some examples of the system, the processing device can be further configured to: receive differential pressure measurements of the fluid corresponding to respective times; generate a pressure curve over time based on the differential pressure measurements of the fluid; and estimate a rheological parameter (e.g. gel strength) of the fluid using the pressure curve over time.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present disclosure which are apparent to one skilled in the art.

Example 1

High temperatures and pressures can influence the rheological properties of drilling fluids by introducing physical, chemical and/or electrochemical changes (White et al. Society of Petroleum Engineers, SPE Drilling and Completion, 1997, SPE-35057-PA). Therefore, conventional drilling fluids (such as invert drilling fluids) can exhibit changes in rheology due to pressure and temperature variations (Young et al. Society of Petroleum Engineers, SPE oil and Gas India Conference and Exhibition, Mumbai, India, 2012, SPE-154682-MS). The rheological parameters of a drilling fluid can be correlated with the effects of temperature and pressure.

Figure 2:
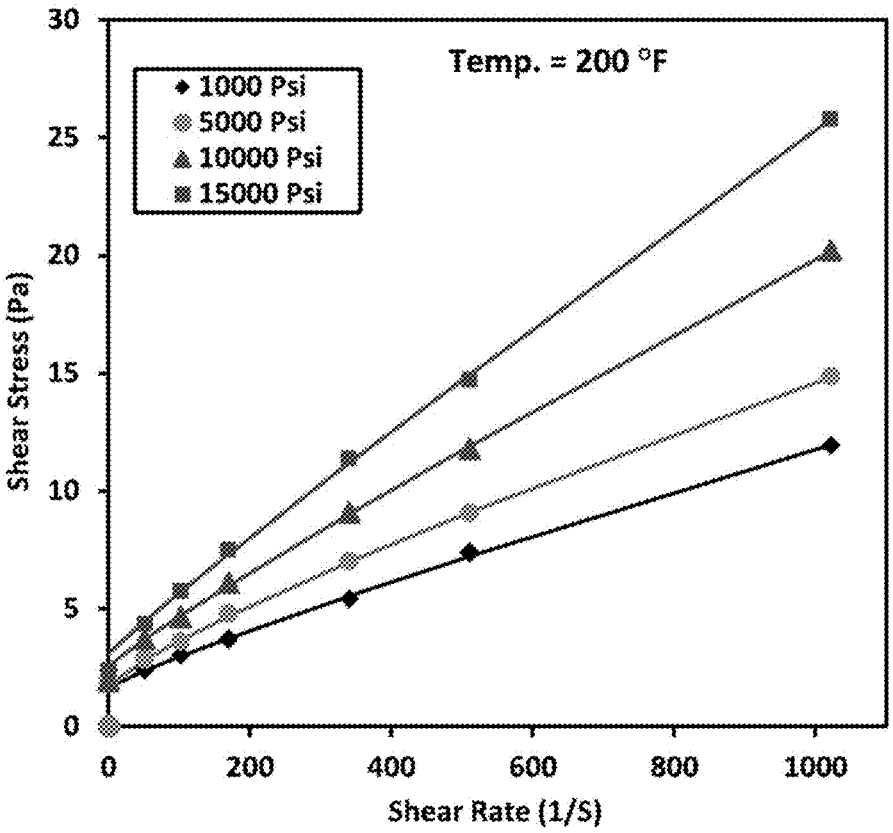
FIG. 2 displays the effect of pressure on the rheological parameters of an 11.8 ppg synthetic based mud (SBM) at 200° F.

To examine the rheological dependence of drilling fluids on temperature and pressure, changes in the rheological properties of an 11.8 ppg reconditioned synthetic based mud (SBM) due to temperature and pressure variations were investigated using shear stress vs. shear rate curves (using the Yield-Pressure Law model and an HPHT viscometer). The effect of pressure on the rheological properties of the drilling fluids at 200° F. are shown in FIG. 2. These results indicate that at the same shear rate, the shear-stress readings and the effective viscosity will increase with pressure.

Figure 3:
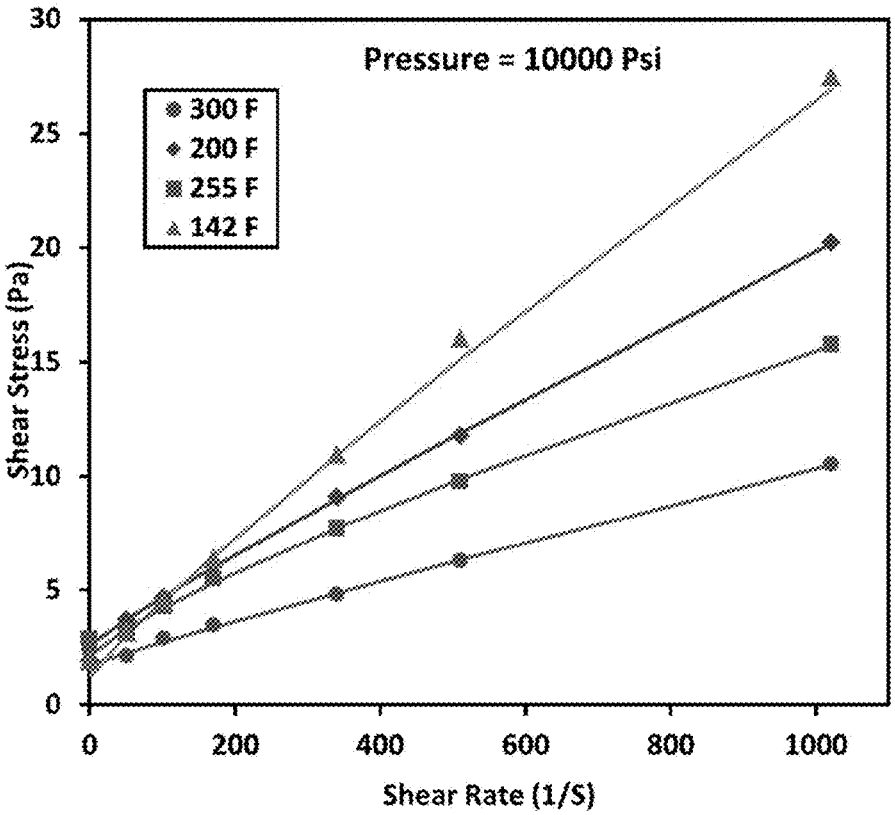
FIG. 3 displays the effect of temperature on the rheological parameters of an 11.8 ppg SBM at 10,000 psi.

The effect of temperature on the rheological properties of the mud at 10,000 psi are shown in FIG. 3. These results indicate that at equivalent shear rate, the shear stress and effective viscosity decreased with increasing temperature.

It was observed that pressure and temperature have countering effects on mud rheological properties for the investigated SBM system. Therefore, in the field and under certain operational conditions, the effective viscosity of the mud may increase, decrease, or remain constant due to increasing pressure and/or temperature. For example, this mud showed approximately similar rheological properties at 5000 psi and 200° F. as at 10,000 psi and 255° F. It was also observed that variations in pressure and temperature slightly had minimal effect on the yield stress, $\tau_y$. This experiment indicates that the rheological properties of muds will continuously be subjected to change in the wellbore due to changes in pressure and/or temperature, introduction of cuttings, contamination by formation fluids, etc.

Example 2

Figure 4:
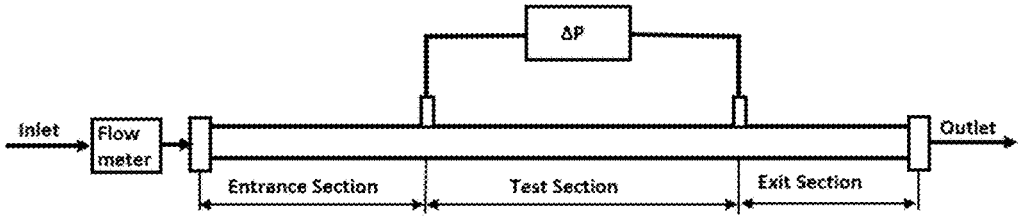
FIG. 4 displays a schematic view of a standard pipe viscometer system.
Figure 5:
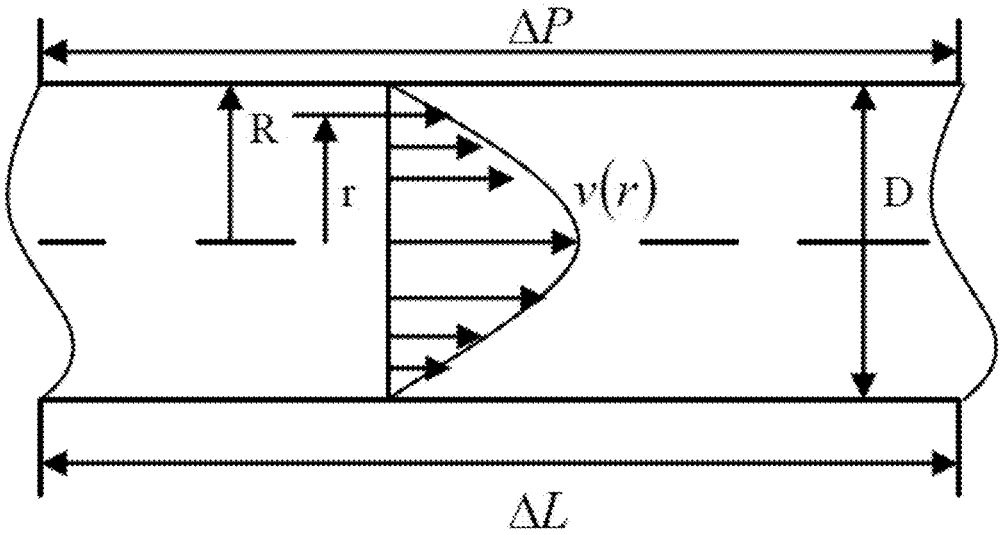
FIG. 5 displays a schematic view of a velocity profile in pipe flow.

A system as disclosed herein was treated as a standard pipe viscometer system (FIG. 4), which is based on measuring flow rate and pressure loss to develop a pipe viscometer model. To develop this model, a short segment was considered in the test section of the viscometer (FIG. 5) with diameter D and length ΔL. Assuming that a no-slip condition is valid at the wall, the velocity profile was obtained from Eq. 1:

$$Q = 2\pi \int_0^R v(r) r dr \quad \text{Eq. 1}$$

Integrating by parts and assuming that velocity at the wall was zero, v(R)=0, Eq. 2 was obtained:

$$Q = -\pi \int_0^R r^2 \frac{dv}{dr} dr \quad \text{Eq. 2}$$

The velocity gradient (shear rate) is a function of shear stress. For isothermal steady state flow of fluid with constant density, Eq. 3 expresses the momentum balance:

$$\tau = \frac{r}{2}\frac{dp}{dl} \quad \text{Eq. 3}$$

Hence, shear rate at the wall was (Eq. 4):

$$\tau_w = \frac{R}{2}\frac{dp}{dl} \quad \text{Eq. 4}$$

By dividing Eq. 3 by Eq. 4, Eq. 5 was obtained:

$$\frac{\tau(r)}{\tau_w} = \frac{r}{R} \quad \text{Eq. 5}$$

By changing variables and replacing r with $$R\frac{\tau(r)}{\tau_w},$$

Eq. 2 becomes Eq. 6:

$$Q = -\pi \int_0^{\tau_w} \left(\frac{R}{\tau_w}\right)^3 \frac{dv}{dr} \tau^2 d\tau \quad \text{Eq. 6}$$

Eq. 6 represents a general relationship between flow rate and shear stress. Knowing that shear rate is a function of shear stress, $$\frac{dv}{dr} = f(\tau),$$

and by using Leibniz's formula for differentiating integrals, Eq. 7 was obtained (upon rearrangement).

$$\frac{d(Q\tau_w^3)}{d\tau_w} = -\pi R^3 f(\tau_w)\tau_w^2 \quad \text{Eq. 7}$$

Therefore, shear rate at the wall was obtained from Eq. 8:

$$f(\tau_w) = \left(\frac{dv}{dr}\right)_R = \dot{\gamma}_w = \frac{1}{\pi R^3 \tau_w^2}\frac{d(Q\tau_w^3)}{d\tau_w} \quad \text{Eq. 8}$$

or $$\dot{\gamma}_w = \frac{1}{\pi R^3}\tau_w \frac{dQ}{d\tau_w} + \frac{3Q}{\pi R^3} \quad \text{Eq. 9}$$

Eq. 9 was rewritten in terms of mean velocity and pipe diameter knowing that $$\frac{Q}{\pi R^3} = \frac{v}{R} = \frac{2v}{D},$$

resulting in Eqs. 10 and 11:

$$\dot{\gamma}_w = \frac{\tau_w}{4}\frac{d\left(\frac{8v}{D}\right)}{d\tau_w} + \frac{3}{4}\left(\frac{8v}{D}\right) \quad \text{Eq. 10}$$

$$\tau_w \frac{d(\ln\tau_w)}{d\tau_w} = \left(\frac{8v}{D}\right)\frac{d\left(\ln\frac{8v}{D}\right)}{d\left(\frac{8v}{D}\right)} \quad \text{Eq. 11}$$

Therefore, $$\frac{d\left(\frac{8v}{D}\right)}{d\tau_w} = \frac{\frac{8v}{D}}{\tau_w}\frac{d\left(\ln\frac{8v}{D}\right)}{d(\tau_w)} \quad \text{Eq. 12}$$

By substituting Eq. 12 into Eq. 10, Eq. 13 was obtained for the shear rate at the wall:

$$\dot{\gamma}_w = \frac{1}{4}\left[3 + \frac{d\left(\ln\frac{8v}{D}\right)}{d(\tau_w)}\right]\left(\frac{8v}{D}\right) \quad \text{Eq. 13}$$

Introducing the generalized flow behavior index (N) as expressed by Eq. 14:

$$N = \frac{d(\tau_w)}{d\left(\ln\frac{8v}{D}\right)} \quad \text{Eq. 14}$$

Eq. 13 was thus written as Eq. 15:

$$\dot{\gamma}_w = \left(\frac{3N+1}{4N}\right)\frac{8v}{D} \quad \text{Eq. 15}$$

Figure 6:
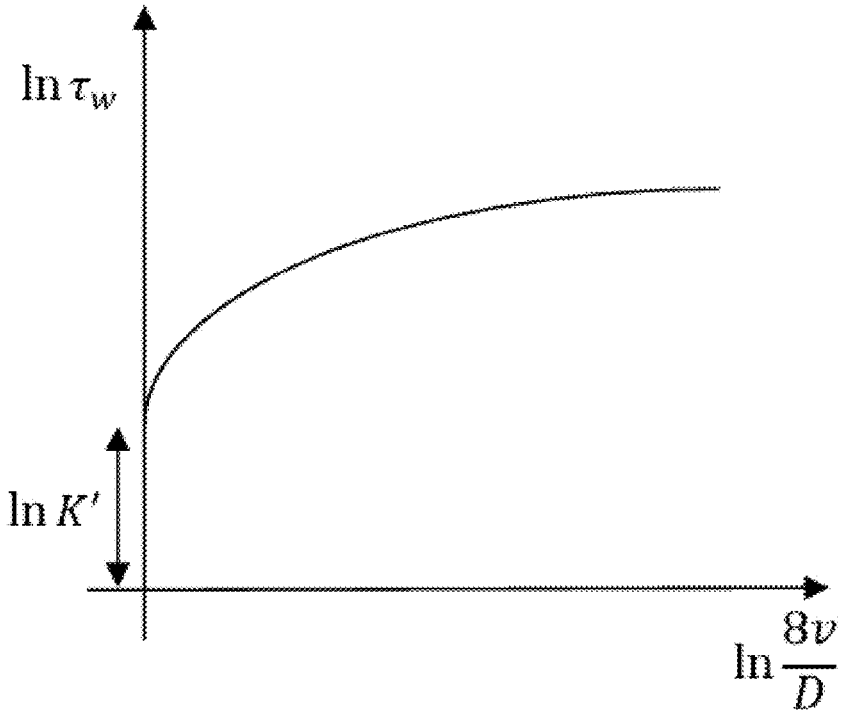
FIG. 6 displays a flow curve comprising the wall shear stress versus nominal Newtonian shear rate on a natural log-natural log plot.

According to Eq. 14, slope of the $$\ln\tau_w \ vs. \ \ln\frac{8v}{D}$$

represents the How behavior index or N. The pipe viscometer data (flow curve) was expressed in terms of wall shear stress versus nominal Newtonian shear rate, $$\frac{8v}{D},$$

on a ln-ln plot, as illustrated in FIG. 6. Once N was obtained from the flow curve, the shear rate at the wall was calculated by using Eq. 13. According to FIG. 6, it was concluded that:

$$\tau_w = K'\left(\frac{8v}{D}\right)^N \quad \text{Eq. 16}$$

wherein K' is the generalized consistency index and is different from consistency index or K. If the log-log plot of wall shear stress versus nominal Newtonian shear rate forms a straight line, the Power-Law model best represents the fluid type. In such a case, the generalized flow behavior index, N, is the same as fluid behavior index, m or N=m.

After finding a term for the generalized flow behavior index, N, the rheological parameters can be determined according to the selected rheological model. Yield Power Law (YPL) is one of the most widely used rheological models and is represented by Eq. 17:

$$\tau = \tau_y + K\left(-\frac{dv}{dr}\right)^m \quad \text{Eq. 17}$$

After plotting the flow curve and finding a relationship for N, shear rate at the wall was calculated by Eq. 15. Subsequently, one can plot $\ln(\tau-\tau_y)$ vs. $\ln \dot{\gamma}_w$ and fit a straight line to the data points. The slope of the line represents the fluid behavior index, m, and K is obtained by knowing the interception with Y-axis. $\tau_y$ can be obtained from an iterative process. The $\tau_y$ value that gives the highest $R^2$ (best fitted line) is used as the yield stress. For the power law fluids, $\tau_y$, is assumed to be zero.

The data presented in Table 1 was obtained from a pipe viscometer with inner diameter of 0.5" using a 6% bentonite suspension, which has specific gravity of approximately one. From this data, the yield power-law model parameters of the fluid were determined (Aadnoy et al., *Advanced Drilling and Well Technology*, Society of Petroleum Engineers 2009).

TABLE 1

Pipe viscometer data for a 6% bentonite suspension

| | Flow rate (gpm) | | | | | | | | | | |
|---|---|---|---|---|---|---|---|---|---|---|---|
| | 10.17 | 8.96 | 7.71 | 6.43 | 5.15 | 3.85 | 2.54 | 1.77 | 0.91 | 0.48 | 0.17 |
| dp/dl ($H_2O$/in) | 3.43 | 2.21 | 1.84 | 1.63 | 1.41 | 1.18 | 0.92 | 0.75 | 0.52 | 0.37 | 0.24 |

Figure 7:
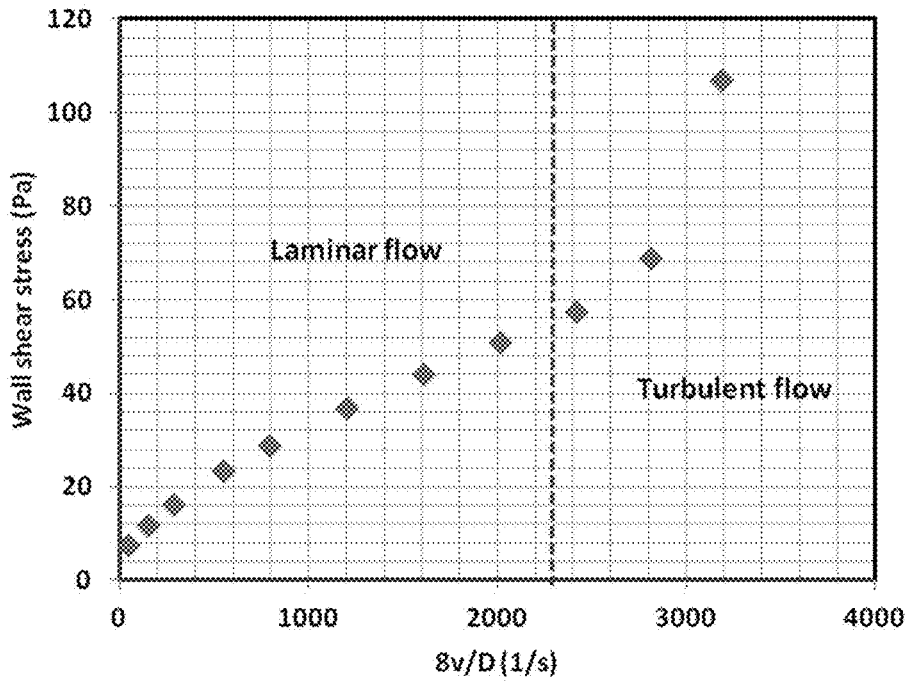
FIG. 7 displays a plot of wall shear stress versus the nominal Newtonian shear rate.
Figure 8:
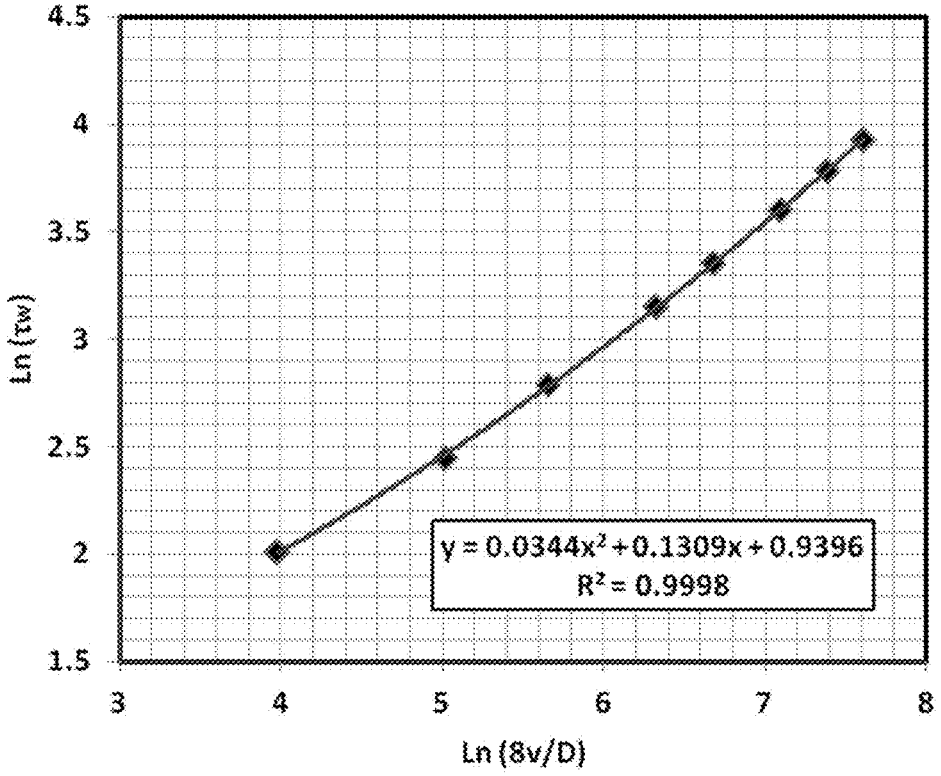
FIG. 8 displays a flow curve of the natural log of $\tau_w$ versus the natural log of the nominal Newtonian shear rate.

According to FIG. 7, three points were out of laminar flow range and these points were excluded from further calculations. According to FIG. 8, $\ln \tau_w$ is related to $$\ln\left(\frac{8v}{D}\right)$$

by a second order polynomial. N is the slope of the polynomial and was obtained by differentiating the presented equation in FIG. 8. Therefore, $$N = 2\times 0.0344\ln\left(\frac{8v}{D}\right) + 0.139 \quad \text{Eq. 18}$$

Subsequently, shear rate at the wall for each flow rate was obtained from Eq. 15 for each velocity. Plot $\ln(\tau-\tau_y)$ vs. $\ln \dot{\gamma}_w$ should be a straight line. This is achieved by iterating the $\tau_y$ value to achieve the highest regression coefficient, $R^2$.

Figure 9:
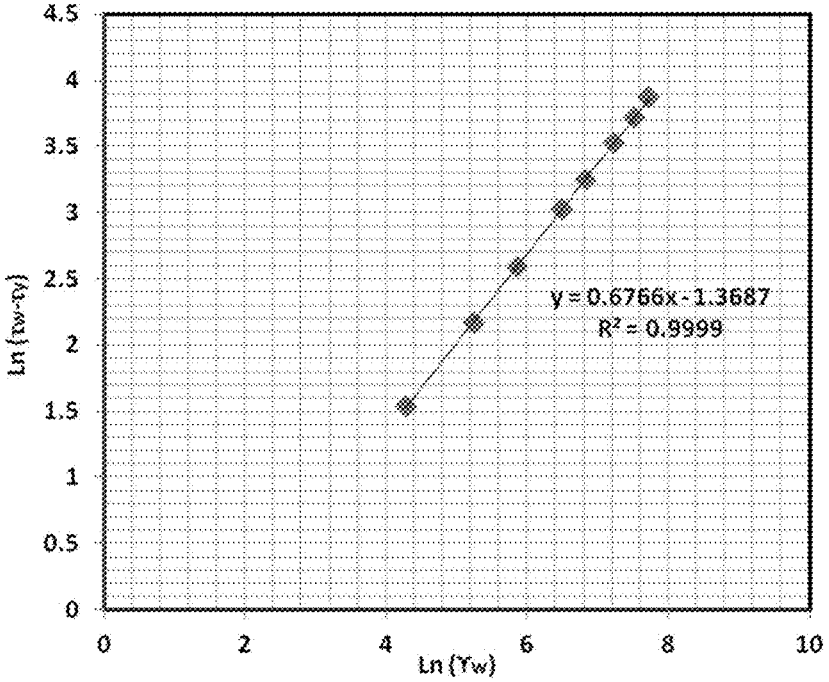
FIG. 9 displays a plot for determining K and m.

In this example, the highest $R^2$ is achieved when $\tau_y$=2.8 Pa. The slope of the straight-line presents m and interception with Y-axis is ln(K). Hence, m=0.68 and K=exp(−1.3687) =0.25 Pa·sec$^{0.68}$ (FIG. 9). Table 2 shows the conducted calculations to obtain the rheological properties.

TABLE 2

Flow parameters

| Vel (m/s) | dp/dl (Pa/m) | $\tau_w$ | 8v/D ($s^{-1}$) | N | y | $\tau_w - \tau_y$ |
|---|---|---|---|---|---|---|
| 5.066 | 33635.88 | 106.79 | 3191.09 | 0.69 | 3542.70 | 103.99 |
| 4.463 | 21672.10 | 68.81 | 2811.42 | 0.69 | 3134.08 | 66.01 |
| 3.840 | 18043.74 | 57.29 | 2419.21 | 0.68 | 2710.36 | 54.49 |
| 3.203 | 15984.40 | 50.75 | 2017.57 | 0.66 | 2274.48 | 47.95 |
| 2.565 | 13826.99 | 43.90 | 1615.94 | 0.65 | 1836.09 | 41.10 |
| 1.918 | 11571.53 | 36.74 | 1208.03 | 0.63 | 1387.50 | 33.94 |
| 1.265 | 9021.87 | 28.64 | 796.99 | 0.60 | 930.57 | 25.84 |
| 0.882 | 7354.78 | 23.35 | 555.38 | 0.57 | 658.51 | 20.55 |
| 0.453 | 5099.32 | 16.19 | 285.54 | 0.53 | 349.34 | 13.39 |
| 0.239 | 3628.36 | 11.52 | 150.61 | 0.48 | 190.75 | 8.72 |
| 0.085 | 2353.53 | 7.47 | 53.34 | 0.41 | 72.33 | 4.67 |

In general, the wall shear rate in pipe and slit flows was expressed by Eq. 19 if instead of $\tau_w$, the average shear stress, $\bar{\tau}_w$, is used. The hydraulic diameter, $D_h$, was equal to pipe diameter, D, for pipe and $D=D_o-D_i$ for slits flow (Ahmed et al., *Wiertnictwo Nafta Gaz,* 2006, 23(1), 47-53). The parameters are: a=0.25, b=0.75 for pipes and a=0.5, b=1, for narrow slits.

$$\bar{\dot{\gamma}}_w = a\bar{\tau}_w\frac{d\left(\ln\frac{8v}{D_h}\right)}{d(\bar{\tau}_w)} + b\left(\frac{8v}{D_h}\right) = \left[\frac{a}{N} + b\right]\frac{8v}{D_h} \quad \text{Eq. 19}$$

Eq. 19 is valid for 0≤e≤95%, 0.2≤n≤1 and 0.2≤κ≤0.8, where e is the dimensionless eccentricity, n is the fluid behavior index, and κ is the diameter ratio. For the eccentric annulus the geometric parameters (a and b) can be calculated as follows:

$$a=a_0e^3+a_1e^2+a_2e+a_3 \quad \text{Eq. 20}$$

$$b=\alpha_0e^3+\alpha_1e^2+\alpha_2e+\alpha_3 \quad \text{Eq. 21}$$

where e is the dimensionless eccentricity, $$e = \frac{E}{D_O - D_I}.$$

E is the offset distance between centers of the inner pipe and outer pipe (borehole). Coefficients for calculating geometric parameters are presented in Table 3. κ is the diameter ratio or $$\kappa = \frac{D_I}{D_O}$$

(Ahmed et al., *Wiertnictwo Nafta Gaz,* 2006, 23(1), 47-53).

TABLE 3

Equations to calculate coefficients for geometric parameters.

| | |
|---|---|
| $a_0 = -2.8711\kappa^2 - 0.1029\kappa + 2.6581$ | $\alpha_0 = 3.0422\kappa^2 + 2.4094\kappa - 3.1913$ |
| $a_1 = 2.8156\kappa^2 + 3.6114\kappa - 4.9072$ | $\alpha_1 = -2.7817\kappa^2 - 7.9865\kappa + 5.8970$ |
| $a_2 = 0.7444\kappa^2 - 4.8048\kappa + 2.2764$ | $\alpha_2 = -0.3406\kappa^2 + 6.0164\kappa - 3.3614$ |
| $a_3 = -0.3939\kappa^2 + 0.7211\kappa + 0.1503$ | $\alpha_3 = 0.2500\kappa^2 - 0.5780\kappa + 1.3591$ |

To calculate the generalized flow behavior index, a similar procedure as pipe flow was applied. However, the pipe diameter was replaced with the hydraulic diameter, $D_h$. Average shear stress at the wall was obtained from Eq. 22:

$$\bar{\tau}_w = \frac{D_h}{4}\frac{dp}{dl} \quad \text{Eq. 22}$$

To assure that flow is laminar, the Reynolds number for an eccentric annulus was obtained from Eq. 23:

$$\mathrm{Re} = \frac{8\rho v^2}{\bar{\tau}_w} \quad \text{Eq. 23}$$

Haciislamoglu and Langlinais (Haciislamoglu and Langlinais, *Journal of Energy Resources,* 1990, 112(3), 163-169) presented a correlation for flow of power law fluids in an eccentric annulus based on numerical simulation results. The correlation is valid for fluid with behavior index ranging from 0.4 to 1.0. It relates the pressure in an eccentric annulus to a concentric one (Eq. 24). This correlation is modified by Zamora et al. (Zamora et al., "Comparing a Basic Set of Drilling Fluid Pressure-Loss Relationships to Flow-Loop", AADE 2005 National Technical Conference and Exhibition, Houston, Apr. 5-7, 2005.) for the turbulent flow, and is presented in Eq. 25.

$$\left(\frac{dp}{dl}\right)_{ecc.} = \left(1 - 0.072\kappa^{0.8454}\frac{e}{n} - 1.5e^2\kappa^{0.1852}\sqrt{n} + 0.96e^3\kappa^{0.2527}\sqrt{n}\right)\left(\frac{dp}{dl}\right)_{con.} \quad \text{Eq. 24}$$

$$\left(\frac{dp}{dl}\right)_{ecc.} = \left(1 - 0.048\kappa^{0.8454}\frac{e}{n} - 0.67e^2\kappa^{0.1852}\sqrt{n} + 0.28e^3\kappa^{0.2527}\sqrt{n}\right)\left(\frac{dp}{dl}\right)_{con.} \quad \text{Eq. 25}$$

Figure 10:
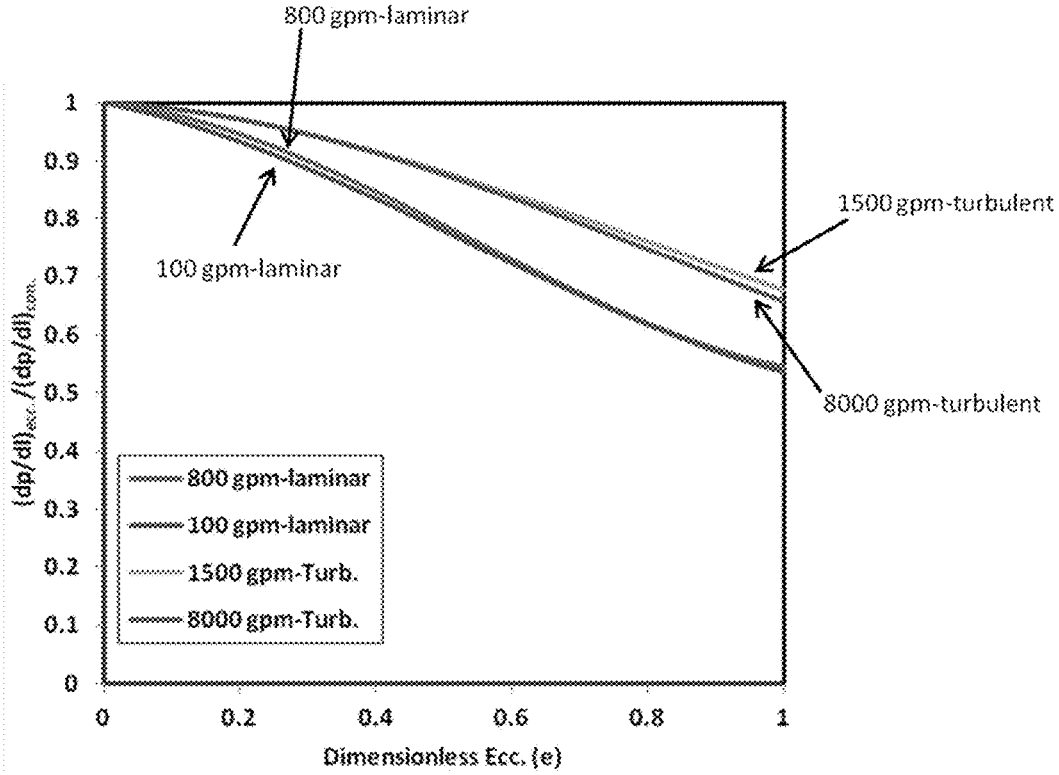
FIG. 10 displays a plot illustrating the effect of eccentricity on pressure drop calculations in the annulus.

To investigate the effect of pipe eccentricity on the pressure drop, a mud sample that was used in the field was considered. Table 4 presents the additional input parameters. The ratio of pressure drop (concentric to eccentric) is plotted versus eccentricity for four different flow rates (FIG. 10). Presented results are obtained from the correlation-based model. FIG. 10 indicates that, in the laminar flow regime, the effect of eccentricity on the pressure drop can be significant. The pressure drop in a fully eccentric annulus is approximately half of the concentric one at 800 gallons per minute (gpm). This indicates the importance of eccentricity in pressure drop calculations. The effect of eccentricity on the pressure drop is more important in the laminar flow pattern. Flow rate does not have a significant impact on the pressure drop ratio.

TABLE 4

Input field data to investigate the effect of pipe eccentricity on pressure drop.

| Property | Values |
|---|---|
| Pipe OD | 5.875" |
| Annulus (Hole) ID | 9.5" |
| Mud weight | 12.6 ppg |
| $O_{600}$ and $O_{300}$ | 103 and 62 |

Figure 11:
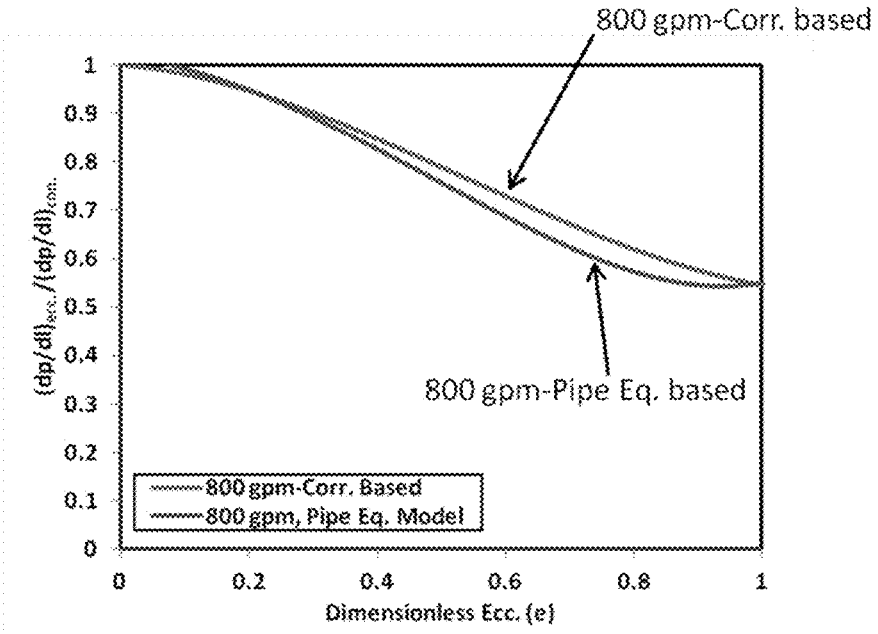
FIG. 11 displays a plot comparing the correlation-based model with the pipe equivalent model for the input data (laminar flow, flow rate=800 gpm).

To evaluate the performance of the equivalent pipe model compared to the correlation-based model, pressure drop ratio was plotted vs. the dimensionless eccentricity, e, at 800 gpm (laminar flow). FIG. 11 shows that when the dimensionless eccentricity is less than 0.5, these models match closely. For higher values of the dimensionless eccentricity, the correlation-based model presents lower reduction in pressure drop compared to the equivalent pipe model. The difference in the predictions from the two models is less than 5%.

Example 3

A wired drill pipe (WDP) was used to provide real-time annular pressure data at very high rates. The WDP was considered to be independent of the drilling fluid type. Since the annular pressure profile was known along the wellbore, the system was considered as an annulus viscometer to provide fluid rheological properties under downhole conditions.

According to the models that described above, frictional pressure drop between the sensors at several flow rates were provided to estimate the real-time drilling fluid properties under downhole conditions. One of the unknowns in the calculations is pipe eccentricity. For the vertical section, a concentric annulus was assumed, while in a deviated section, a fully eccentric annulus was assumed.

Figure 12:
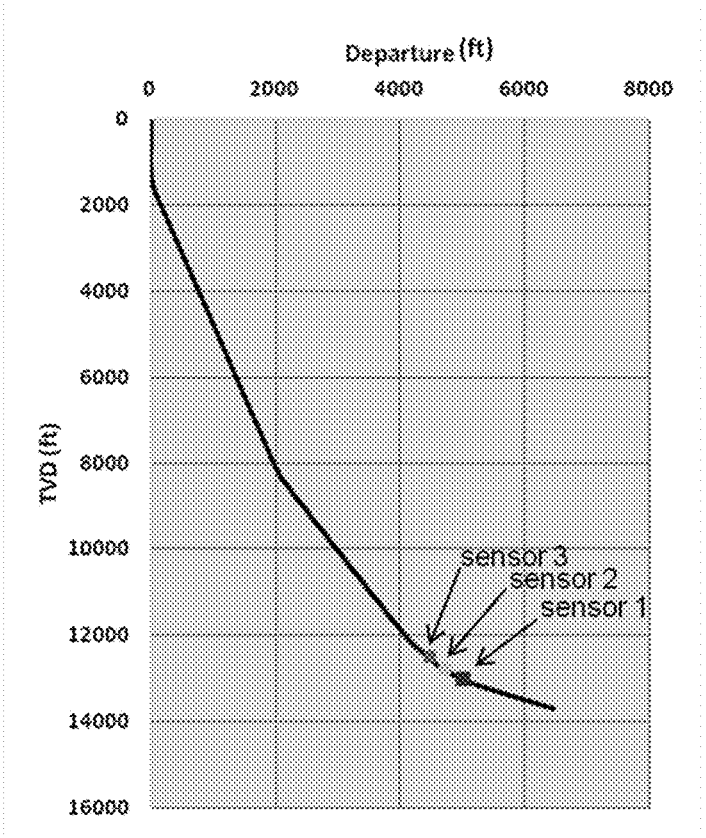
FIG. 12 displays the well path and location of three downhole pressure sensors.

In order to validate the applicability of the proposed idea in the field, pressure data obtained from the WDP was used. FIG. 12 demonstrates the well path and the location of the three mounted pressure sensors along the wellbore using the WDP. The distance from the sensors (sensor 1, sensor 2 and sensor 3 in FIG. 12) to the drill bit is 695.8, 1076.2 and 1456 ft.

Figure 13:
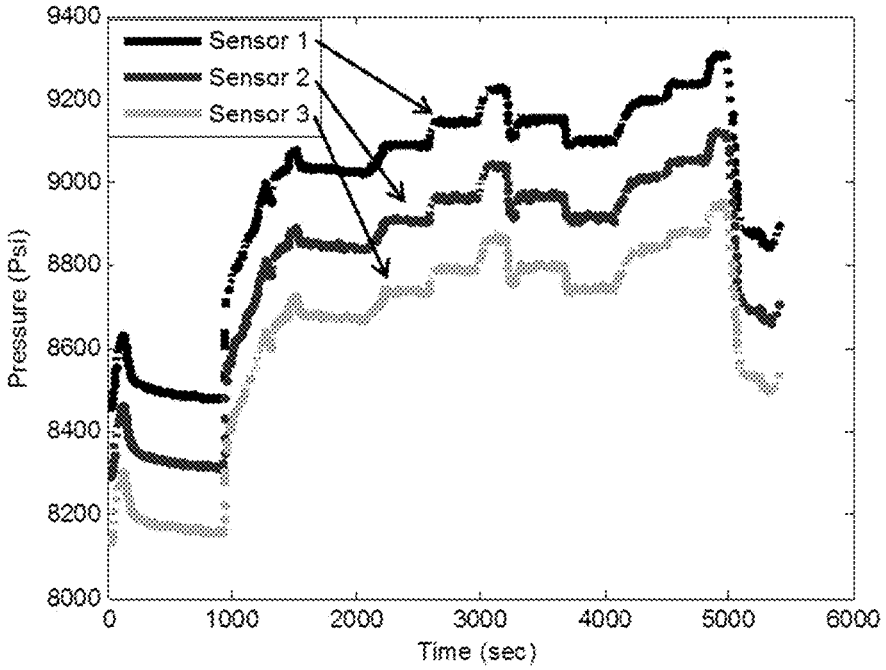
FIG. 13 displays the pressure profile at three mounted sensors on wired drill pipe (WDP) for the 12.6 ppg mud.
Figure 14:
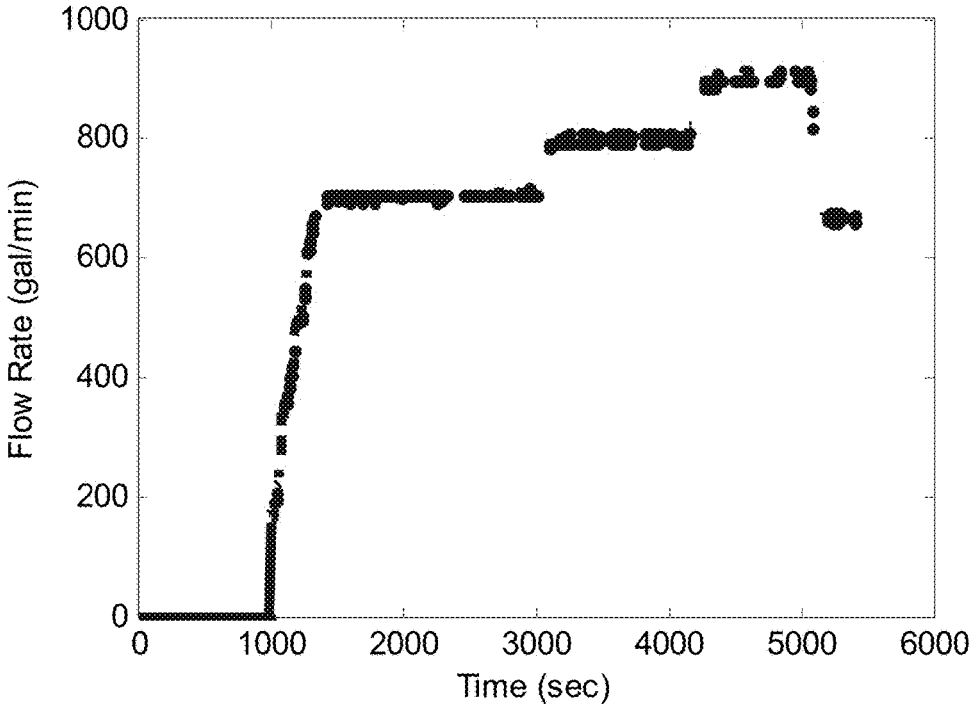
FIG. 14 displays mud pumping rate versus time for the 12.6 ppg mud.
Figure 15:
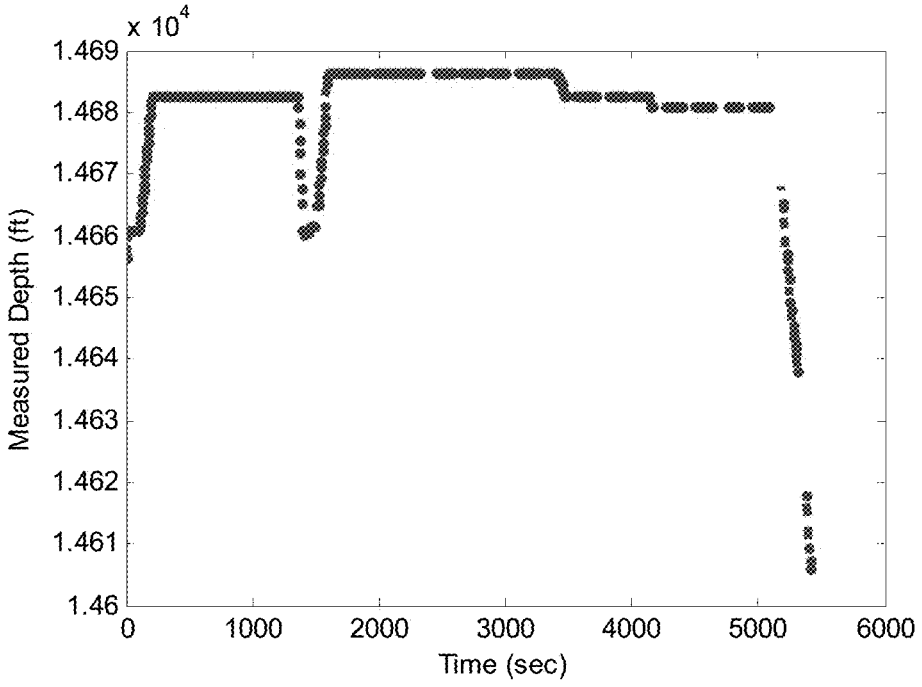
FIG. 15 displays measured depth versus time for the 12.6 ppg mud.

FIG. 13 shows the pressure profile at the three sensors with time at various flow rates for 12.6 pounds per gallon (ppg) synthetic-based mud. FIG. 14 shows the mud pumping rate vs. time. FIG. 15 presents the measured depth vs. time. Table 5 presents the frictional pressure drop at three flow rates for the 12.6 ppg synthetic-based mud between sensor 1 and 2. The gravitational pressure drop was obtained when the mud pumps were off and the data points were selected periods when the drillstring was stationary (no surge or swab pressure) and cutting loading effects were minimal. Subsequently, total pressure drop at various flow rates was recorded. To increase accuracy, an average flow rate was determined for each period. The frictional pressure drop was obtained by subtracting the gravitational pressure from the total pressure at each flow rate. Hole geometry and drilling fluid properties at the surface are presented in Table 4.

TABLE 5

Flow rate, frictional pressure drop and other flow parameters for 12.6 ppg mud.

| Q (gpm) | dp/dl (Psi/ft) | dp/dl (corrected for eccentricity) | $\tau_{w_ave}$ | $12v/D_{hyd}$ ($s^{-1}$) | N |
|---|---|---|---|---|---|
| 704 | 0.0315 | 0.0480 | 25.51 | 205.02 | 0.754 |
| 793 | 0.0341 | 0.0530 | 27.57 | 230.94 | 0.715 |
| 898 | 0.0368 | 0.0571 | 29.75 | 261.52 | 0.675 |

Figure 16:
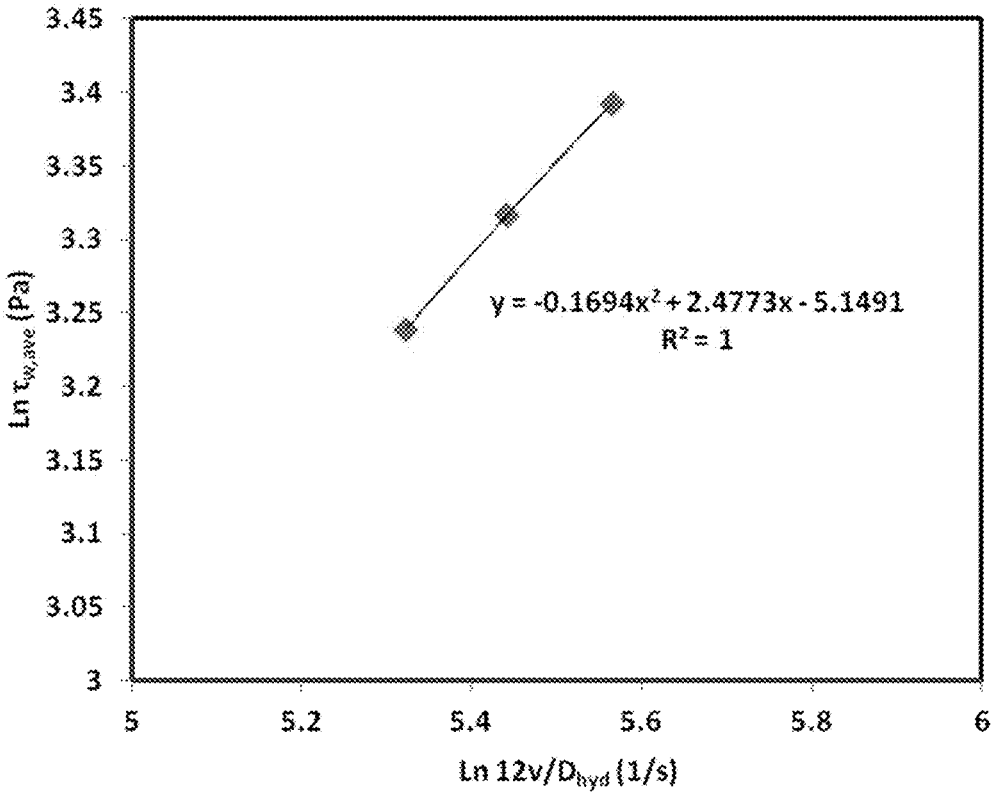
FIG. 16 displays the natural log of $\bar{\tau}_w$ versus the natural log of $12v/D_{hyd}$ for the 12.6 ppg mud.
Figure 17:
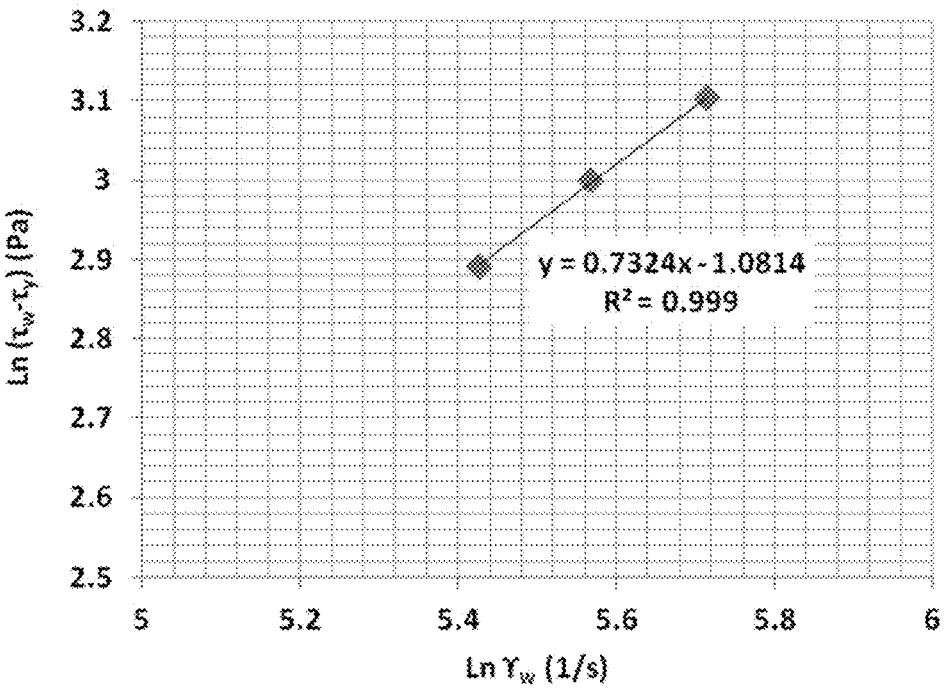
FIG. 17 displays the plot from which the rheological parameters can be obtained for the Yield-Power Law model for the 12.6 ppg mud.
Figure 18:
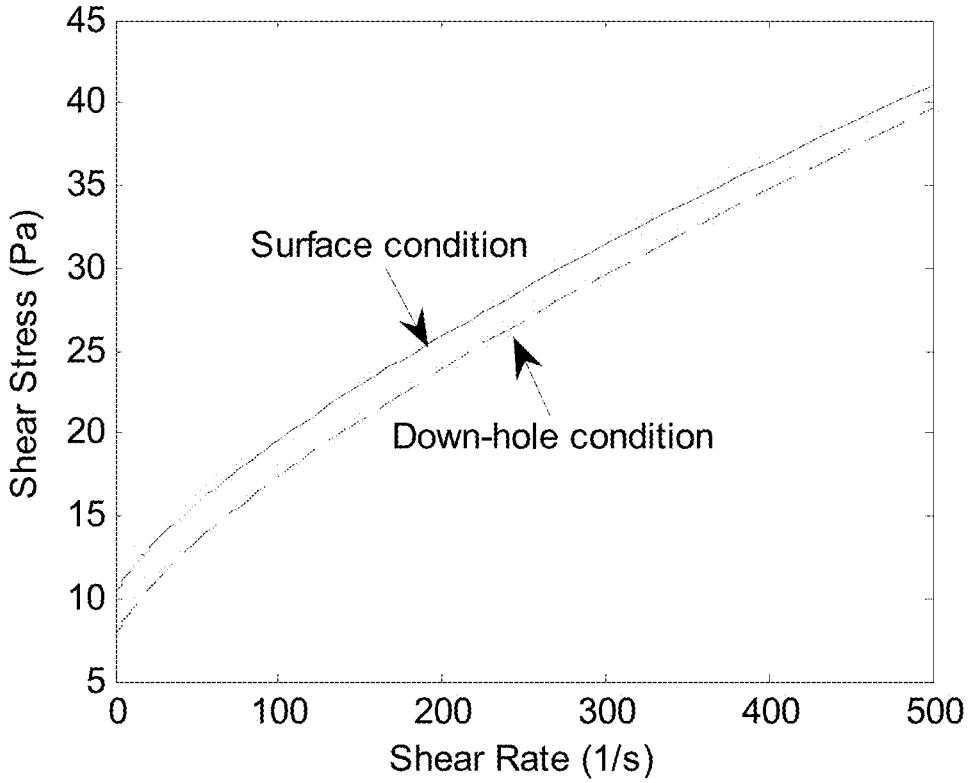
FIG. 18 displays a comparison of the fluid parameters under surface and down-hole conditions using the Yield-Power Law model for the 12.6 ppg mud.

The $$\ln\bar{\tau}_w \text{ vs. } \ln\frac{12v}{D_{hyd}}$$

was plotted in FIG. 16. It was assumed that the annulus was fully eccentric. Therefore, the pressure drop values were corrected for eccentricity by using the correlation approach. The generalized flow behavior index, N, was obtained from this figure. By obtaining N, the average shear rate at the wall, $\dot{\bar{\gamma}}_w$, was calculated. Subsequently, to obtain the fluid parameters under down-hole conditions, $\ln\bar{\tau}_w$ vs. $\ln\dot{\bar{\gamma}}_w$ was plotted (FIG. 17). FIG. 17 indicates that by using the Yield Power Law (YPL) model, m=0.7324, K=0.3391 pa·sec$^{0.7324}$ and $\tau_y$=7.49 pa. FIG. 18 compares the downhole fluid parameters with the surface values and shows that the fluid's rheological parameters under downhole conditions are slightly different compared to the surface values.

Example 4

Figure 19:
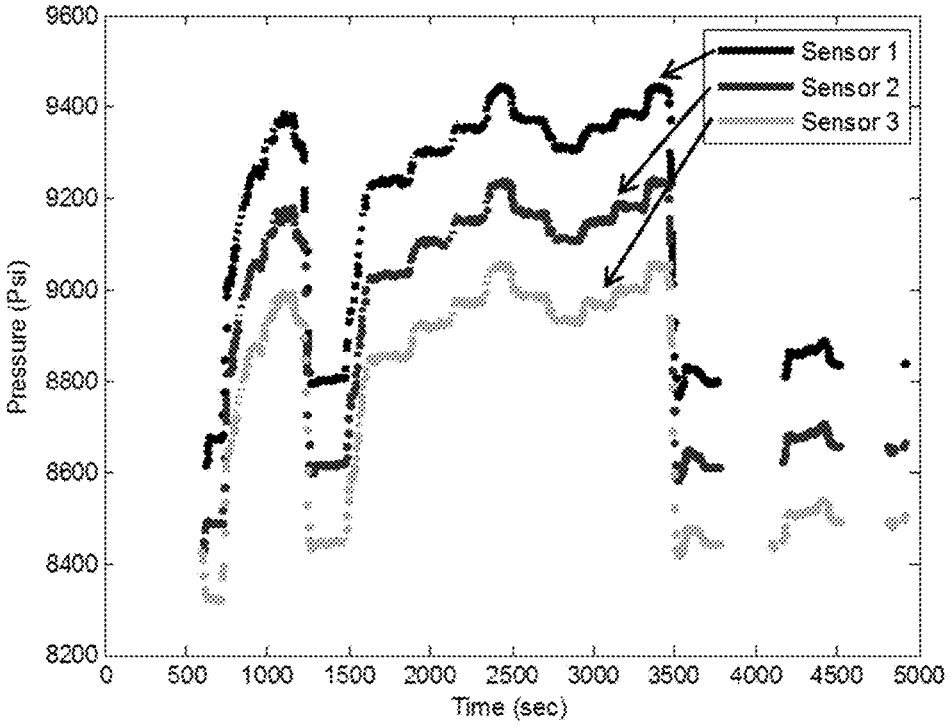
FIG. 19 displays the pressure profiles at the three mounted sensors on WDP for a 13.1 ppg mud.
Figure 20:
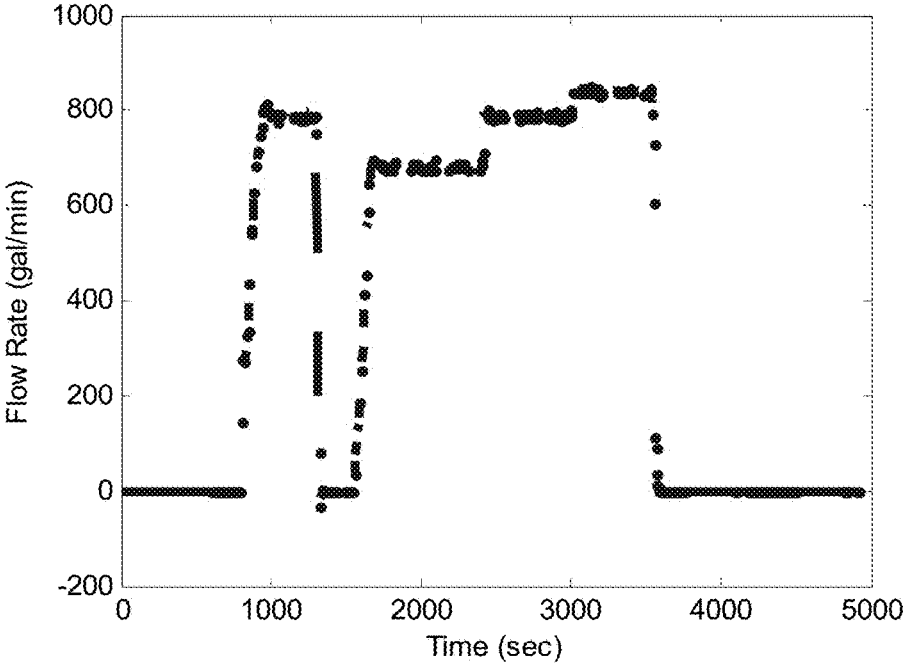
FIG. 20 displays the mud pumping rate versus time for the 13.1 ppg mud.

Example 4 was conducted in the manner described above for Example 3 except using 13.1 ppg mud. FIG. 19 shows the pressure profile at 3 sensors with time at three flow rates. FIG. 20 shows the mud pumping rate vs. time. Table 6 presents the values of pressure drop and corrected pressure drop corresponding to each flow rate. It is assumed that pipe was fully eccentric and dimensionless eccentricity is one. Since mud yield point is not provided, for simplicity the Power Law model is used ($\tau_y$=0).

TABLE 6

Flow rate, frictional pressure drop and other flow parameters for 13.1 ppg mud.

| Q (gpm) | dp/dl (Psi/ft) | dp/dl (corrected for eccentricity) | $\tau_{w_ave}$ | $12v/D_{hyd}$ ($s^{-1}$) | N |
|---|---|---|---|---|---|
| 684 | 0.0341 | 0.0530 | 27.57 | 199.20 | 0.648 |
| 790 | 0.0373 | 0.0579 | 30.16 | 230.07 | 0.648 |
| 840 | 0.039 | 0.0606 | 31.53 | 244.63 | 0.648 |

Figure 21:
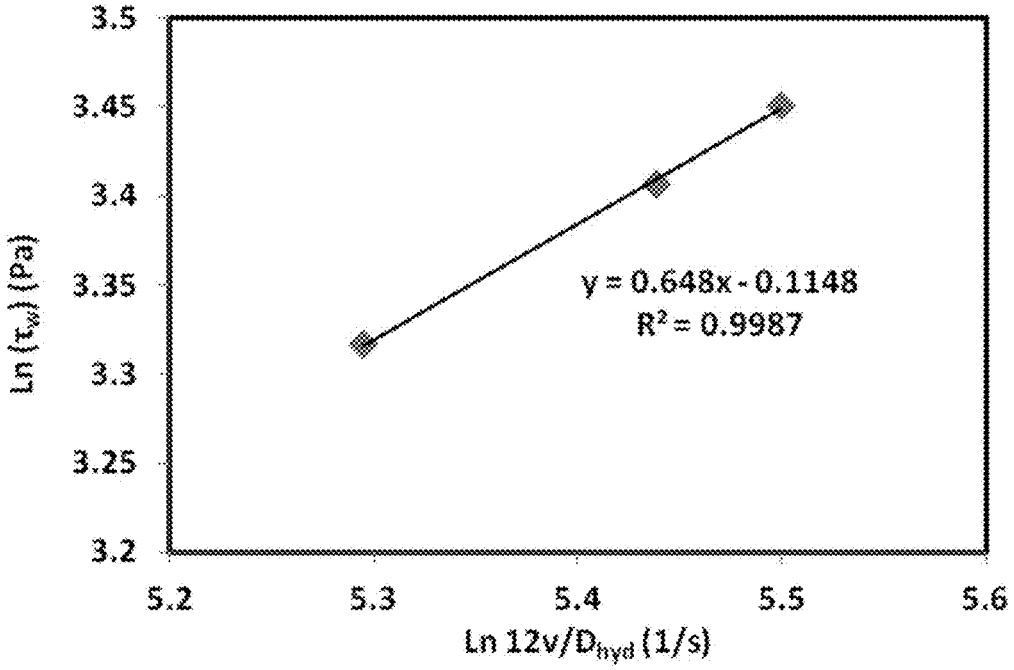
FIG. 21 displays the natural log of $\bar{\tau}_w$ versus the natural log of $12v/D_{hyd}$ for the 13.1 ppg mud.
Figure 22:
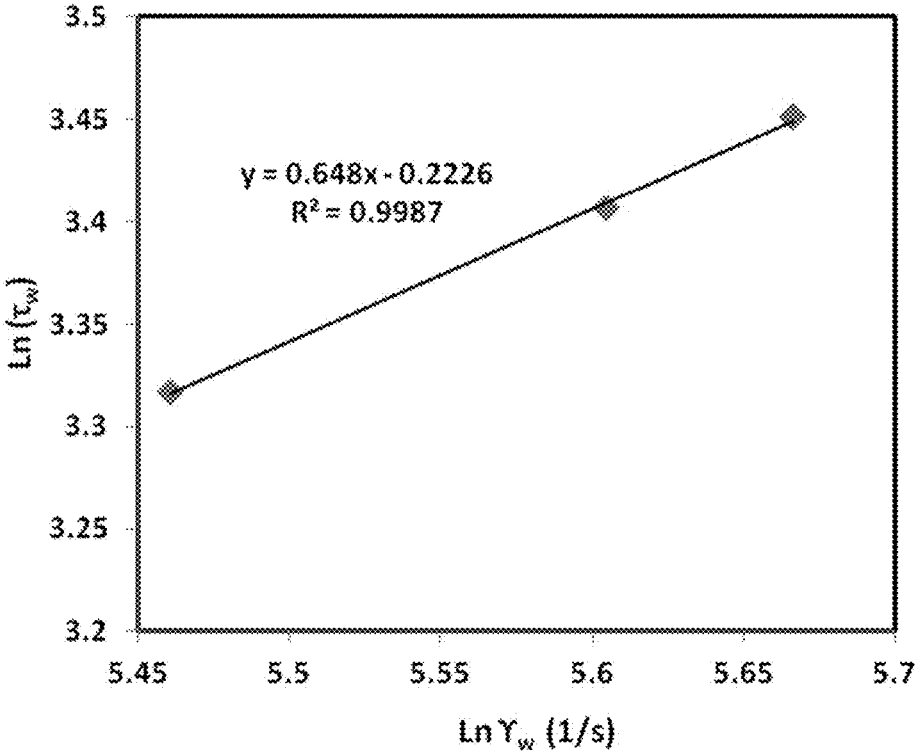
FIG. 22 displays the plot from which the rheological parameters can be obtained for the Yield-Power Law model for the 13.1 ppg mud.
Figure 23:
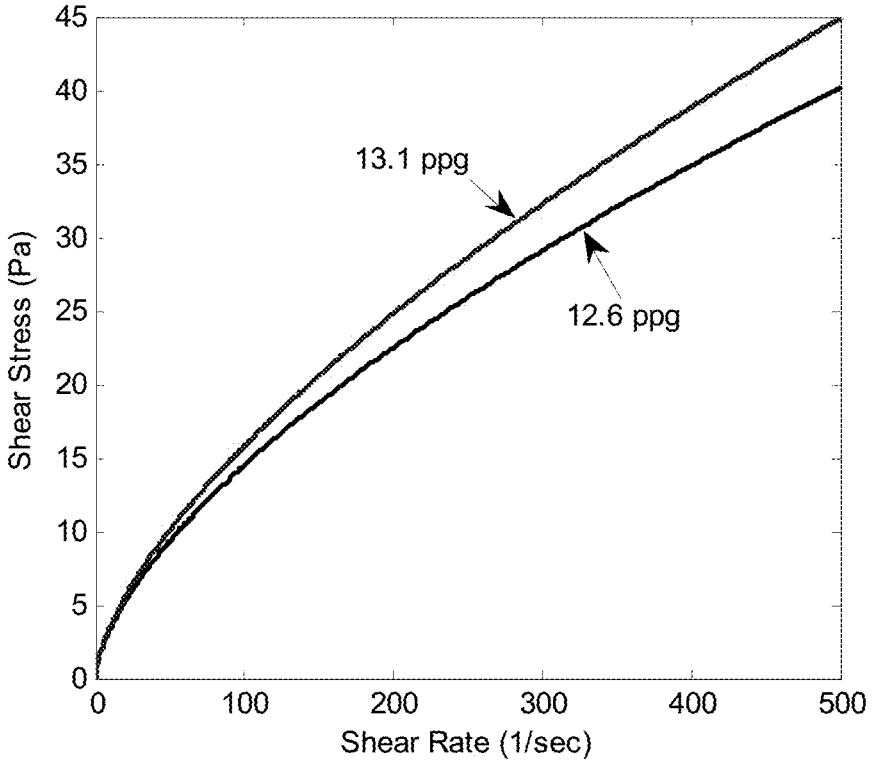
FIG. 23 displays a comparison of the fluid parameters of the 12.6 ppg mud and 13.1 ppg mud under down-hole conditions.

The $$\ln\bar{\tau}_w \text{ vs. } \ln\frac{12v}{D_{hyd}}$$

was plotted in FIG. 21. The slope of the straight line fitted to the data points represents the generalized flow behavior index, N, which is equal to the fluid behavior index, m, in this case. By knowing N, the average shear rate at the wall $\dot{\bar{\gamma}}_w$, was calculated. To obtain the consistency index, $\ln\bar{\tau}_w$ vs. $\ln\dot{\bar{\gamma}}_w$ was plotted in FIG. 22. This figure indicates that by using the Power Law model, m=0.648, K=0.800 pa·sec$^{0.648}$. For comparison purposes, the same method was applied for the 12.6 ppg mud discussed above. Results indicate that for the 12.6 ppg mud using the Power Law Model m=0.633, K=0.786 pa·sec$^{0.633}$. FIG. 23 compares the shear rate-shear stress plot of 12.6 ppg synthetic-based mud with the 13.1 ppg synthetic based mud. As expected, since the 13.1 ppg mud is more viscous due to a higher solids content, the obtained shear stress is higher for the 13.1 ppg mud than the 12.6 ppg mud for the same shear rate.

Example 5

A further complication of non-Newtonian fluids is time dependent (transient) behavior. Some fluids require a gradually increasing shear stress to maintain a constant strain rate and are called rheopectic. The opposite case of a fluid, which thins out with time and requires decreasing stress is termed thixotropic. Drilling fluids usually will exhibit a thixotropic behavior at the time circulation is started. This is due to a non-Newtonian parameter called "gel strength," which is the stress required to initiate circulation. The gel strength can help keep particles in suspension when circulation is stopped.

Traditionally, gel strength was measured at the surface using a rotational viscometer using the API approach. This approach is very simplistic, in that the gel strength can be affected significantly by downhole pressure and temperature. Furthermore, it is not possible to investigate the sophisticated time-dependent behavior of drilling fluids by using the API approach. Having access to downhole pressure sensors makes it possible to determine the gel strength measurement of the drilling fluid in real time. In addition, by developing the proper models and finding the model parameters, the gel strength and the amount of required pressure to break the gel can be predicted with time.

The gel strength of the drilling fluid can be estimated if the pressure gradient required to start the circulation is known. Since the shear stress is greatest at the pipe wall, initial fluid movement will occur at this location. By equating the shear stress to gel strength:

$$\frac{dp_f}{dL} = \frac{2\tau_g}{(r_O - r_I)} \qquad \text{Eq. 26}$$

Figure 24:
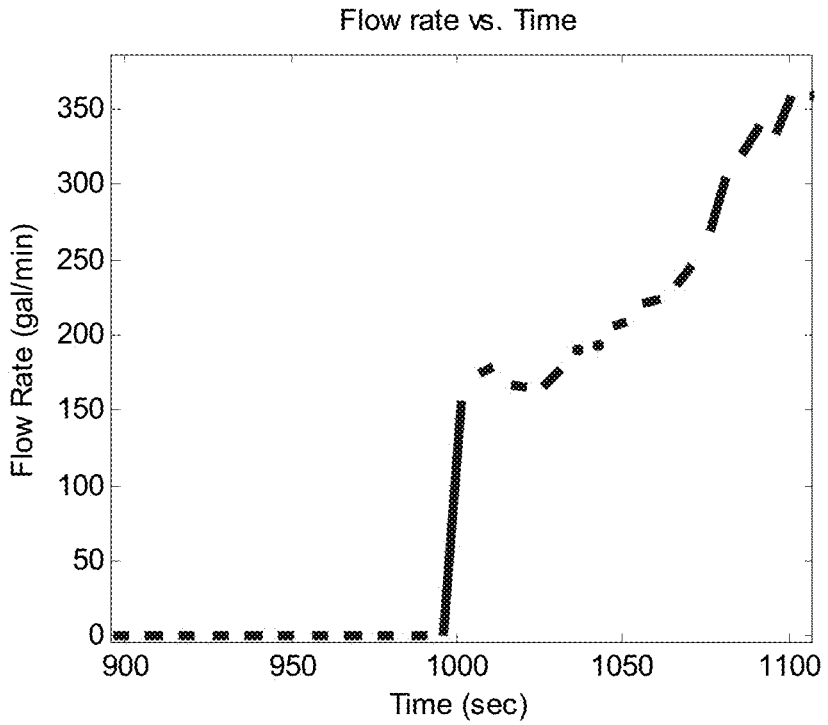
FIG. 24 displays the flow rate versus time for the 12.6 ppg mud when circulation is initiated.
Figure 25:
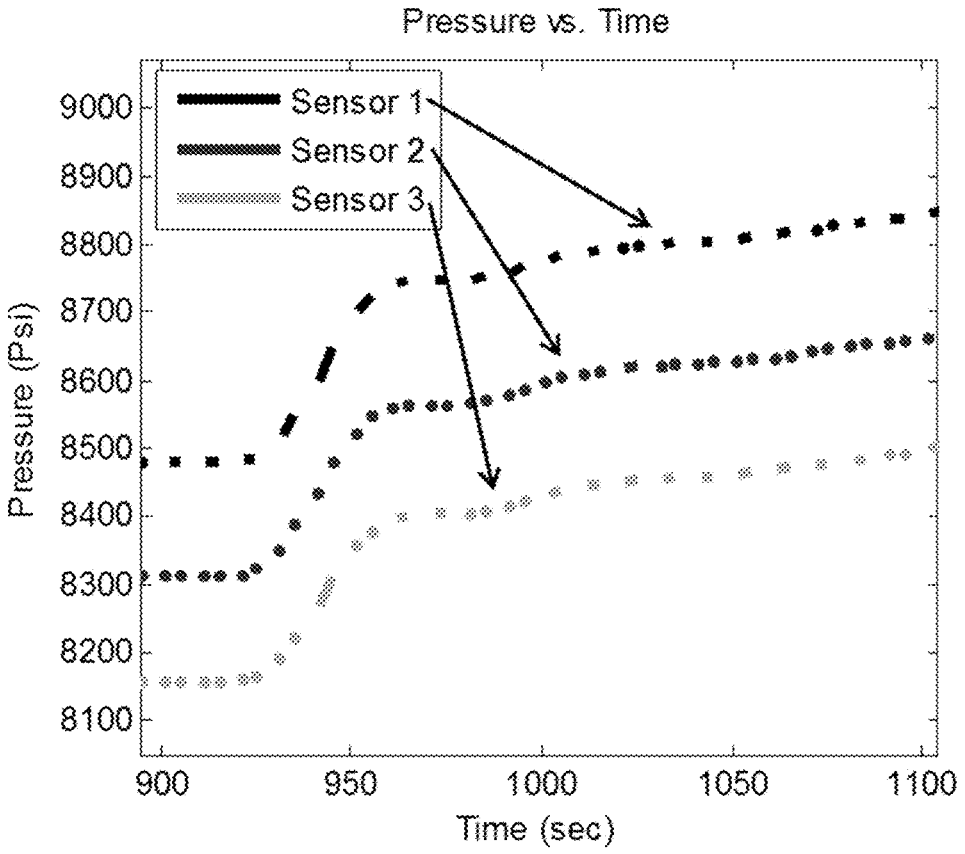
FIG. 25 displays the pressure at three sensors with time for the 12.6 ppg mud when circulation is initiated.

Therefore, by knowing the peak pressure drop when circulation is initiated, gel strength was estimated by using Eq. 26. FIG. 24 shows the flow rate vs. time for 12.6 ppg mud when circulation is initiated. FIG. 25 shows the pressure variations at the sensors for a similar time span. According to this figure, the pressure at the sensors increased when circulation started. The peak pressure was estimated from FIG. 25. Gel strength was then determined by knowing the wellbore geometry and using Eq. 26. According to the presented figures, gel strength for this mud is approximately 24.3

$$\frac{\text{ln}}{100\ \text{ft}^2}.$$

The methods and systems of the appended claims are not limited in scope by the specific methods and systems described herein, which are intended as illustrations of a few aspects of the claims and any methods and systems that are functionally equivalent are intended to fall within the scope of the claims. Various modifications of the methods and systems in addition to those shown and described herein are intended to fall within the scope of the appended claims. Further, while only certain representative method steps and system components disclosed herein are specifically described, other combinations of the method steps and system components also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches.

What is claimed is:

1. A method for determining a rheological parameter of a fluid within a wellbore, comprising:

receiving, using a processing device, a plurality of measured flow rates and a plurality of differential pressure measurements corresponding to the plurality of measured flow rates of the fluid flowing within a flow region of the wellbore, wherein the plurality of differential pressure measurements are received from a plurality of pressure sensors arranged along a conduit situated within the wellbore, and wherein the plurality of differential pressure measurements are obtained at downhole conditions of the wellbore;

storing, using the processing device, the plurality of measured flow rates and the plurality of differential pressure measurements corresponding to the plurality of measured flow rates;

generating, using the processing device, a curve based on the plurality of differential pressure measurements, the plurality of measured flow rates, or a combination thereof; and determining, using the processing device, the rheological parameter of the fluid using the curve;

wherein the flow region comprises an area inside the conduit situated within the wellbore, or the flow region comprises an annulus, the annulus being a region between the conduit and the wellbore; and wherein the conduit comprises a wired drill pipe.

2. The method of claim 1, wherein receiving, using a processing device, the plurality of differential pressure measurements of the fluid within a flow region of the wellbore comprises:

receiving, using a processing device, pressure measurements of the fluid from the plurality of pressure sensors; and calculating, using the processing device, the plurality of differential pressure measurements of the fluid from the pressure measurements.

3. The method of claim 1, wherein the generating and determining steps comprise generating, using the processing device, a pressure curve based on the plurality of differential pressure measurements, and determining, using the processing device, the rheological parameter of the fluid using the pressure curve.

4. The method of claim 1, wherein the plurality of flow rates includes at least three different flow rates.

5. The method of claim 1, wherein the generating and determining steps comprise:

generating, using the processing device, a flow curve based on the plurality of differential pressure measurements and the plurality of flow rates;

determining, using the processing device, a flow behavior index for the fluid from the flow curve; and determining, using the processing device, the rheological parameter of the fluid using the flow curve and a rheological model.

6. The method of claim 5, wherein the rheological model comprises a model that relates shear stress and shear rate.

7. The method of claim 1, wherein the flow region comprises an area inside a conduit situated within the wellbore.

8. The method of claim 1, wherein the flow region comprises an annulus, wherein the annulus of the wellbore is a region between a conduit and the wellbore.

9. The method of claim 8, further comprising correcting, using the processing device, the plurality of differential pressure measurements of the fluid for eccentricity between the conduit and the wellbore.

10. The method of claim 9, wherein the plurality of differential pressure measurements of the fluid are corrected for the eccentricity between the conduit and the wellbore using an equivalent pipe model, a correlation-based model, or a combination thereof.

11. The method of claim 1, further comprising:

receiving, using the processing device, times corresponding to each of the plurality of differential pressure measurements of the fluid;

generating, using the processing device, a pressure curve over time based on the plurality of differential pressure measurements of the fluid; and estimating, using the processing device, a gel strength of the fluid using the pressure curve over time.

12. The method of claim 1, wherein the rheological parameter includes a shear stress and a shear rate of the fluid.

13. The method of claim 1, wherein the plurality of pressure sensors comprises at least three pressure sensors.

14. The method of claim 1, wherein the fluid comprises a drilling fluid.

15. A system for determining a rheological parameter of a fluid within a wellbore, comprising:

a conduit arranged in a wellbore, wherein the conduit comprises a wired drill pipe;

a flow meter configured to measure flow rate of the fluid flowing within the wellbore;

a plurality of pressure sensors along the conduit configured to measure pressure of the fluid within the wellbore at downhole conditions of the wellbore; and a processing device configured to:

receive a plurality of flow rates of the fluid from the flow meter;

receive a plurality of differential pressure measurements of the fluid from the pressure sensors, wherein the plurality of differential pressure measurements correspond to the plurality of flow rates;

store the plurality of flow rates and the plurality of differential pressure measurements corresponding to the plurality of measured flow rates;

generate a curve based on the plurality of differential pressure measurements, the plurality of flow rates, or a combination thereof; and determine the rheological parameter of the fluid using the curve.

16. The system of claim 15, wherein the processing device is configured to generate a pressure curve based on the plurality of differential pressure measurements and determine the rheological parameter of the fluid using the pressure curve.

17. The system of claim 15, wherein the processing device is configured to:

generate a flow curve based on the plurality of differential pressure measurements corresponding to the plurality of flow rates of the fluid; and determine the rheological parameter of the fluid using the flow curve and a rheological model.

18. The system of claim 17, wherein the rheological model comprises any model that relates shear stress and shear rate.

19. The system of claim 15, wherein the plurality of pressure sensors along the conduit are configured to measure the pressure of the fluid flowing within an annulus of the wellbore, the annulus of the wellbore being a region between the conduit and the wellbore.

20. The system of claim 15, wherein receiving the plurality of differential pressure measurements of the fluid from the pressure sensors comprises:

receiving pressure measurements of the fluid from the pressure sensors; and calculating the plurality of differential pressure measurements of the fluid from the pressure measurements.

21. The system of claim 15, wherein the processing device is further configured to correct the plurality of differential pressure measurements of the fluid for eccentricity between the conduit and the wellbore.

22. The system of claim 21, wherein the plurality of differential pressure measurements of the fluid are corrected for the eccentricity between the conduit and the wellbore using an equivalent pipe model, a correlation-based model, or a combination thereof.

23. The system of claim 15, wherein the processing device is further configured to:

receive respective times corresponding to each of the plurality of differential pressure measurements of the fluid;

generate a pressure curve over time based on the plurality of differential pressure measurements of the fluid; and estimate a gel strength of the fluid using the pressure curve over time.

24. The system of claim 15, wherein the rheological parameter includes a shear stress and a shear rate of the fluid.

25. The system of claim 15, wherein the plurality of pressure sensors comprises at least three pressure sensors.

26. The system of claim 15, wherein the fluid comprises a drilling fluid.

* * * * *